US005965343A

United States Patent [19]

Nishimura

[11] Patent Number: 5,965,343

[45] Date of Patent: Oct. 12, 1999

[54] SILVER HALIDE PHOTOGRAPHIC EMULSION, METHOD FOR PRODUCING THEREOF, AND LIGHT-SENSITIVE MATERIAL USING THE SAME

[75] Inventor: Ryoji Nishimura, Kanagawa, Japan

[73] Assignee: Fuji Photo Film Co., Ltd., Kanagawa, Japan

[21] Appl. No.: 08/781,716

[22] Filed: Jan. 10, 1997

[30] Foreign Application Priority Data

Jan. 10, 1996 [JP] Japan ..... 8-2335

[51] Int. Cl.[6] ..... G03C 1/035; G03C 1/015

[52] U.S. Cl. ..... 430/567; 430/569

[58] Field of Search ..... 430/567, 569

[56] References Cited

U.S. PATENT DOCUMENTS

| | | | |
|---|---|---|---|
| 5,061,609 | 10/1991 | Piggin et al. | 430/569 |
| 5,061,616 | 10/1991 | Piggin et al. | 430/569 |
| 5,496,694 | 3/1996 | Kikuchi et al. | 430/567 |
| 5,498,516 | 3/1996 | Kikuchi et al. | 430/567 |
| 5,691,131 | 11/1997 | Maskasky | 430/639 |
| 5,709,988 | 1/1998 | Black et al. | 430/567 |

FOREIGN PATENT DOCUMENTS

| | | | |
|---|---|---|---|
| 4-149541 | 5/1992 | Japan | G03C 1/015 |

*Primary Examiner*—Mark F. Huff

*Attorney, Agent, or Firm*—Birch, Stewart, Kolasch & Birch, LLP

[57] ABSTRACT

A method for producing a silver halide photographic emulsion, a method for producing thereof, and a light-sensitive material using the same, the method comprising the steps of: (a) producing a host emulsion comprising silver bromide or silver iodobromide tabular grains having an average silver iodide content ($I_1$ mol %) of the entire silver halide grains of 5 mol % or less, in which 60% or more of the projected area of the entire silver halide grains accounting for tabular grains having an aspect ratio of 3.0 or more; (b) dissolving a periphery of the tabular grains completely with an iodide ion being added to the host emulsion; and then (c) producing final tabular grains by reclaiming a periphery containing silver iodobromide from the region containing the periphery having been completely dissolved.

20 Claims, 2 Drawing Sheets

REGION A ON THE LINES OR WITHIN THE REGION SURROUNDED BY FOUR LINES CONNECTING IN ORDER FOUR POINTS REPRESENTED BY (TEMPERATURE, pAg) (55, 9.66), (55, 10.74), (80, 8.78) AND (80, 9.85).

REGION B ON THE LINES OR WITHIN THE REGION SURROUNDED BY FOUR LINES CONNECTING IN ORDER FOUR POINTS REPRESENTED BY (TEMPERATURE, pAg) (55, 8.74), (55, 10.74), (80, 8.00) AND (80, 9.85).

SILVER HALIDE PHOTOGRAPHIC EMULSION, METHOD FOR PRODUCING THEREOF, AND LIGHT-SENSITIVE MATERIAL USING THE SAME

FIELD OF THE INVENTION

The present invention relates to a silver halide photographic emulsion, a method for producing thereof and a light-sensitive material using the same and, specifically, relates to a silver halide grain emulsion which is high sensitive and less in fluctuations in photographic properties due to mechanical stress, a method for producing thereof and a light-sensitive material using the same.

BACKGROUND OF THE INVENTION

Various mechanical stresses are put on a photographic material coated with a silver halide emulsion, in general. For example, a negative film for general photographing is rolled up into a magazine, folded when loading in a camera, or pulled for frame sliding. Further, an emulsion face is pressed in a swollen state, in some cases, depending on processors when an exposed negative film is development processed.

As described above, when various stresses are put on a photographic material, stresses are put on silver halide grains through gelatin, which is a binder of silver halide grains, and a plastic film support. It is known that if stress is put on silver halide, photographic properties of a photographic material are fluctuated. Examples thereof are disclosed in detail, for example, in K. B. Mother, *J. Opt. Soc. Am.,* 38 (1948), p. 1054, P. Faelens and P. de Smet, *Sci. et Ind. Phot.,* 25, No. 5 (1954), p. 178, and P. Faelens, *J. Phot. Sci.,* 2 (1954), p. 103.

With respect to tabular silver halide grains, production methods and techniques for using thereof have been disclosed in U.S. Pat. Nos. 4,433,048 and 4,434,226, etc. It has been known in this field of industry that the shape of tabular grains has various advantages which contribute to the improvement of sensitivity/graininess relationship, the improvement of sharpness due to the peculiar optical nature of tabular grains and the improvement of covering power, and tabular grains have supported the rapid progress of silver halide photographic materials in recent years.

Because of their peculiar "tabular shape", on the other hand, the performance degradation of photographic properties by stress (pressureability) of tabular grains is large, and therefore, various means have been contrived to cope with this drawback.

For example, U.S. Pat. No. 4,806,461, JP-A-63-220238 and JP-A-3-189642 (the term "JP-A" as used herein means an "unexamined published Japanese patent application") disclose techniques for improving sensitivity/graininess relationship, dependency on illumination intensity of exposure, pressureability and storage stability by introducing dislocation lines into tabular silver halide grains while controlling.

The technique of improving sensitivity/graininess ratio by forming tabular silver iodobromide grains having iodide nonuniformly dispersed in the grains is disclosed in U.S. Pat. No. 4,414,310. Further, JP-A-3-136032, JP-A-3-136033 and U.S. Pat. No. 5,061,616 disclose techniques of improving the desensitization due to pressure by forming a silver bromoiodide thin layer shell which comprise adding iodide to a tabular host emulsion and then prescribing the pAg and the temperature. However, the techniques disclosed therein only refer to the improvement of the desensitization due to pressure among the degradations of photographic properties caused by various stresses. Therefore, the effects of these techniques have been insufficient concerning very important and annoying performance degradations of photographic properties due to other stresses in photographic materials, that is, stress marks by folding and stress marks in a swollen state of a coated film.

While, in recent years, demands for tabular silver halide emulsions have become increasingly strict, in particular, the development of high sensitivity emulsions which are improved in performance degradation of photographic properties due to various stresses has been desired.

SUMMARY OF THE INVENTION

Accordingly, an object of the present invention is to resolve the above-described problems of the prior art and provide a method for producing a silver halide emulsion which is high sensitive and less in fluctuation in photographic properties due to stresses.

Another object of the present invention is to provide a silver halide emulsion produced by the above method and a silver halide photographic material using the emulsion.

As a result of eager studies, the above objects of the present invention have been attained by the following means.

(1) A method for producing a silver halide photographic emulsion comprising the steps of:

(a) producing a host emulsion comprising silver bromide or silver iodobromide tabular grains having an average silver iodide content ($I_1$ mol %) of the entire silver halide grains of 5 mol % or less, in which 60% or more of the projected area of said entire silver halide grains accounting for tabular grains having an aspect ratio of 3.0 or more;

(b) dissolving a periphery of said tabular grains completely with an iodide ion being added to said host emulsion; and then (c) producing final tabular grains by reclaiming a periphery containing silver iodobromide from the region containing said periphery having been completely dissolved.

(2) A method for producing a silver halide photographic emulsion as described in (1), wherein ($I_2$–$I_1$) is from 0 to 8, where 12 mol % represents the ratio of said iodide ion added in step (b) to the total amount of silver contained in said host emulsion.

(3) A method for producing a silver halide photographic emulsion as described in (1) or (2), wherein the temperature T° C. and the pAg of said host emulsion, when an iodide ion is added to said host emulsion, are within the region A in FIG. 3.

(4) A method for producing a silver halide photographic emulsion as described in any one of (1) to (3), wherein said tabular grains in said host emulsion have two or more interior regions substantially different in silver iodide contents and the silver iodide content of the outermost layer of said tabular grains in said host emulsion is substantially zero.

(5) A method for producing a silver halide photographic emulsion as described in any one of (1) to (4), wherein said periphery reclaimed in step (c) of said final tabular grains has dislocation lines.

(6) A silver halide photographic emulsion produced by the method described in any one of (1) to (5).

(7) A silver halide photographic material comprising a support having provided thereon a photographic emulsion layer containing a silver halide photographic emulsion produced by the method described in any one of (1) to (5).

DETAILED DESCRIPTION OF THE INVENTION

Figure 1:
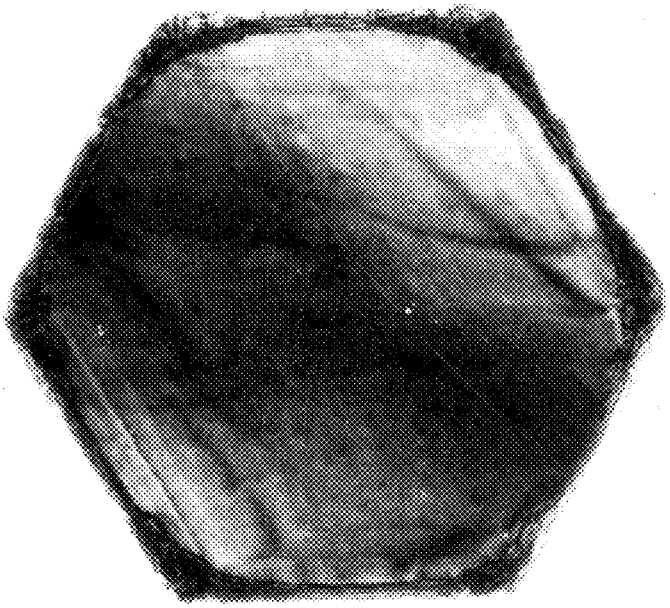
FIG. 1 is a high voltage electron microphotograph of a silver halide grain produced according to the present invention.

The present invention will be described in detail below.

Silver halide grains of the present invention are basically produced according to three steps of a host grain forming step (step (a)), a dissolution step by the addition of an iodide ion (step (b)), and a silver iodobromide thin layer forming step (step (c)). Each step is described in detail below.

A host grain forming step (step (a)) according to the present invention comprises at least a nucleation process, a ripening process and a growing process. These processes are disclosed in detail in U.S. Pat. No. 4,945,037. A ripening process and a growing process may be carried out repeatedly in arbitrary orders. A growing process is a process of adding an aqueous solution of silver salt and an aqueous solution of halide to a mixer according to a double jet method. Mixers to be used are preferably mixers capable of adding each aqueous solution within a liquid, e.g., those disclosed in U.S. Pat. No. 3,785,777 and West German Patent 2,556,888.

A method in which the pAg in the liquid phase in which the silver halide is formed is kept constant, that is, a controlled double jet method, can also be used as one type of the double jet method. A silver halide emulsion having a regular crystal form and almost uniform grain size can be obtained according to this method.

The host grain according to the present invention is a tabular silver halide grain having one twin plane or two or more twin planes parallel to each other. In this case, when ions at all the lattice points at both sides of (111) plane are in enantiomer relationship, the twin plane means this (111) plane.

An aspect ratio in tabular silver halide grains (tabular grains) means the ratio of the diameter to the thickness of the tabular grains, that is, an aspect ratio is defined as the value obtained by dividing the diameter by the thickness of each silver halide grain. Herein, the diameter means the diameter of the circle of the area corresponding to the projected area of the grain when silver halide grains are observed with a microscope or an electron microscope. Accordingly, aspect ratio of 3 or more means the diameter of the circle is 3 times or more as larger than the thickness of the grain.

One example of a measuring method of an aspect ratio is a method in which the circle-corresponding diameter and the thickness of each grain are measured from a transmission type electron microphotograph by a replica method. In this case, the thickness is calculated from the length of the shadow of the replica.

In the host emulsion for use in the present invention, 60% or more of the projected area of the entire silver halide host grains account for tabular grains having an aspect ratio of 3.0 or more, preferably 5.0 or more, and more preferably 7.0 or more. If an aspect ratio is too large, the variation coefficient of the grain size distribution becomes large, accordingly, in general, an aspect ratio is preferably 20 or less.

When the grains in the host emulsion (host grains) for use in the present invention are silver iodobromide, the variation coefficient of the grain size distribution is preferably 25% or less, more preferably 20% or less.

The diameter of the above-described host grain is preferably from about 0.2 to 5.0 $\mu$m, more preferably from 0.3 to 4.0 $\mu$m, and still more preferably from 0.4 to 3.0 $\mu$m. Further, the thickness of the host grain is preferably less than about 0.5 $\mu$m, more preferably from 0.05 to 0.5 $\mu$m, and still more preferably from 0.08 to 0.4 $\mu$m.

The host grains for use in the present invention are preferably silver bromide or silver iodobromide. When the host grains are silver iodobromide, the average silver iodide content $I_1$ of the grains is 5 mol % or less. If it exceeds 5 mol %, complete dissolution of the periphery of the host grain in the process of conversion by an iodide ion (step (b)), which will be described later, becomes difficult. As a result, the aspect ratio of the final grains reduces and the variation coefficient of the grain size distribution becomes large. Therefore, $I_1$ is necessary to be set 5 mol % or less.

$I_1$ is more preferably 4 mol % or less. Further, the host grains may contain silver chloride and the preferred content of silver chloride is preferably 8 mol % or less, more preferably 3 mol % or less, and most preferably 0 mol %.

The host grain for use in the present invention may have at least two or more interior regions having substantially different halide compositions in the grain, as far as $I_1$ is 5 mol % or less. The host grain may have a uniform halide composition, but the structure preferably comprises two or more halide compositions. The boundary between different halide compositions of the grain may be distinct or may be made of a continuous change in composition.

When the host grain having two or more structures having different halide compositions is used, the halide composition of the outermost layer preferably comprises silver bromide substantially not containing silver iodide.

The silver iodide content of the grain surface can be measured by an XPS method (X-ray Photoelectron Spectroscopy).

The principle of an XPS method is described in detail, for example, in Jun-ichi Aihara et al., *Denshi no Bunko*

(*Spectroscopy of Electron*), Kyoritsu Library 16, Kyoritsu Shuppan, 1978.

A standard measuring method of XPS is a method of measuring the strengths of the photoelectrons of iodine (I) and silver (Ag) released from the silver halide grain of an appropriate form of a sample using Mg—Kα as an exciting X-ray. The content of iodine can be obtained from the calibration curve of the strength ratio of the photoelectrons of I and Ag (strength (I)/strength (Ag)) prepared using several kinds of standard samples the contents of iodine of which are known. In the case of silver halide emulsion, the gelatin adsorbed onto the surface of a silver halide grain must be decomposed and removed with proteolytic enzyme or the like before XPS measurement.

The average silver iodide content can be measured by analyzing the composition of the grain one by one with an X-ray microanalyzer. The "average silver iodide content" means the arithmetical mean value obtained by measuring the silver iodide content of at least 100 emulsion grains with an X-ray microanalyzer. The method of measuring the silver iodide content of individual emulsion grain is disclosed, for example, in EP-A-147868.

The silver amount of the host emulsion for use in the present invention is preferably from 3% to 97%, more preferably from 30% to 90%, and most preferably from 50% to 90%, based on the total silver amount of the entire emulsion.

The host emulsion for use in the present invention may be reduction sensitized. Reduction sensitization is conducted by ordinary methods known in the field of the industry such as the addition of reducing agents and the like or the reduction by high pH.

The host emulsion grains for use in the present invention may be prepared by previously forming grains and through washing and precipitation process and being added as a seed emulsion or may be prepared by growing a seed emulsion.

The halogen conversion step by an iodide ion (step (b)) is described in detail below.

The term "dissolution" used in the present invention means that the periphery of the tabular grain having a hexagonal or triangular shape is dissolved and becomes rounded in shape by the addition of an iodide ion to the tabular silver halide host grains which is hardly soluble. The term "periphery" used herein means the region outside of the circle inscribed by at least three sides of the hexagonal or triangular tabular grain within the major (111) faces. In the present invention, the periphery of the tabular host grain is "completely dissolved" and not incompletely dissolved. That is, the entire periphery is dissolved. This terminology "completely dissolved" includes that the dissolution reaches concentric circles having smaller radii than the above inscribed circle. Accordingly, the dissolution of the present invention is definitely distinguished from the dissolution of a vertex in the prior art, which is possible to occur at the time when silver iodide which is more hardly soluble salt than the silver halide host grain or high silver iodobromide of solid solubility limit region is formed. In one embodiment of the present invention, it can be observed from the electron microphotograph in FIG. 1 that the periphery of the tabular grain having been subjected to the dissolution process is completely dissolved.

JP-A-63-220238, JP-A-3-136032, JP-A-3-136033 and JP-A-4-149541 can be cited as close to the embodiment of the present invention. The techniques of these patents fundamentally comprise three processes of (1) preparation of a substrate grain, (2) provision of a high iodide layer, and (3) covering with a silver iodobromide layer having "a lower silver iodide content than that of (2)".

With respect to the provision of a high iodide layer (2), JP-A-63-220238 discloses that it is important for iodide rather to be present locally on a substrate tabular grain than adsorbed onto a grain uniformly. The present invention is characterized in that the host grain is dissolved by an iodide ion and is apparently different from the epitaxial formation of localized silver iodobromide.

In the disclosure of JP-A-4-149541, dislocation lines are concentrated only in the vicinity of the vertex of a tabular grain, which is fundamentally different from the conception of the present invention. As one embodiment thereof, there is a method of dissolving only the vicinity of a vertex with an iodide ion, but the technique of the present invention is characterized in that not only the periphery of a vertex but the entire periphery including a vertex is completely dissolved. Another embodiment thereof is to substantially dissolve only the vicinity of a vertex with a silver halide solvent, which is also different from the present invention. Still another embodiment thereof is a method via halogen conversion in which potassium iodide is added to host grains as an orientating compound, subsequently silver chloride is epitaxially grown only at the vertex part of a host grain limitedly (accordingly, silver chloride is not grown in the site where iodide is present), and then the silver chloride epitaxis is selectively halogen-converted with potassium iodide, which is also different that of the present invention.

Emulsion B-3 disclosed in JP-A-4-149541, which may be the closest to the present invention, is dissolved outside of the preferred temperature-pAg range of the present invention.

In JP-A-3-136032, iodide as a silver salt is adhered on the periphery of a host tabular grain, further, the iodide as a silver salt is rapidly introduced into the system at that time (added as silver iodide Lippmann emulsion in the working examples). This mode of the above patent is different from the addition method of an iodide ion to the system of the present invention. Further, the pAg at that time of the present invention is far higher than that of the above patent.

The embodiment of JP-A-3-136033 is characterized in that silver iodobromide thin layers having a silver iodide content higher than that of the host grains are formed on the major faces of tabular grains, and at that time, the aqueous solution containing a bromide ion and an iodide ion in admixture is added with an aqueous solution of a silver salt and silver iodobromide thin layers of from 5 mol % to 40 mol % are formed on the host grains so as not to cause phase separation. According to the embodiment of the present invention, only an aqueous solution containing an iodide ion is added to the host grains and the pAg at that time of the present invention is far higher than that of the above patent. Therefore, the embodiment of the present invention is apparently different from that of the above patent.

The technique of the present invention is to completely dissolve the periphery of the host tabular grains by the addition of only the aqueous solution containing an iodide ion on the host tabular grains containing the prescribed amount of silver iodide. As a result, the production of a high sensitive emulsion can be realized without deteriorating photographic sensitivity against various stresses. In particular, the above effect is further conspicuously exhibited by regulating the total amount of the iodide ion to be added and the iodide composition of the host grains, or regulating the temperature and the pAg at the time of the addition of the iodide ion.

The dissolution process by the addition of an iodide ion (step (b)) of the present invention can be attained by the addition of a halide solution containing an iodide ion. When an iodide ion is added, the addition of an aqueous solution of silver salt such as silver nitrate is substantially not conducted.

For achieving the effective dissolution according to the present invention, the total amount of the iodide ion to be added is preferably such a value that $(I_2-I_1)$ is from 0 to 8, in which the silver iodide content in the host grains as $I_1$ (mol %), and the value obtained by dividing the total mol number of the iodide ion amount by the total mol number of the silver amount of the host grains and multiplying by 100 as $I_2$ (mol %).

When this value becomes negative values, effective dissolution is difficult to be generated and accompanied by lowering in sensitivity. When this value is greater than 8, host grains are liable to be dissolved excessively and the silver iodide content per one grain becomes extremely large, as a result, lowering in sensitivity soft gradation and pressure desensitization are brought about.

The value of $(I_2-I_1)$ is more preferably from 0 to 4.

The concentration of the iodide ion to be added in the present invention is preferably lower, specifically, 0.2 mol/liter or less, most preferably 0.1 mol/liter or less.

The time required for the addition of the iodide ion in the present invention is preferably 5 minutes or more, more preferably 10 minutes or more.

An iodide ion may be directly added to a reaction vessel using a nozzle which is usually used for adding an aqueous solution of a silver salt or an aqueous solution of halide to a reaction vessel, or may be added at the position above the liquid surface of the reaction solution, but is preferably added using a nozzle used for adding an aqueous solution of a silver salt or an aqueous solution of halide.

Figure 3:
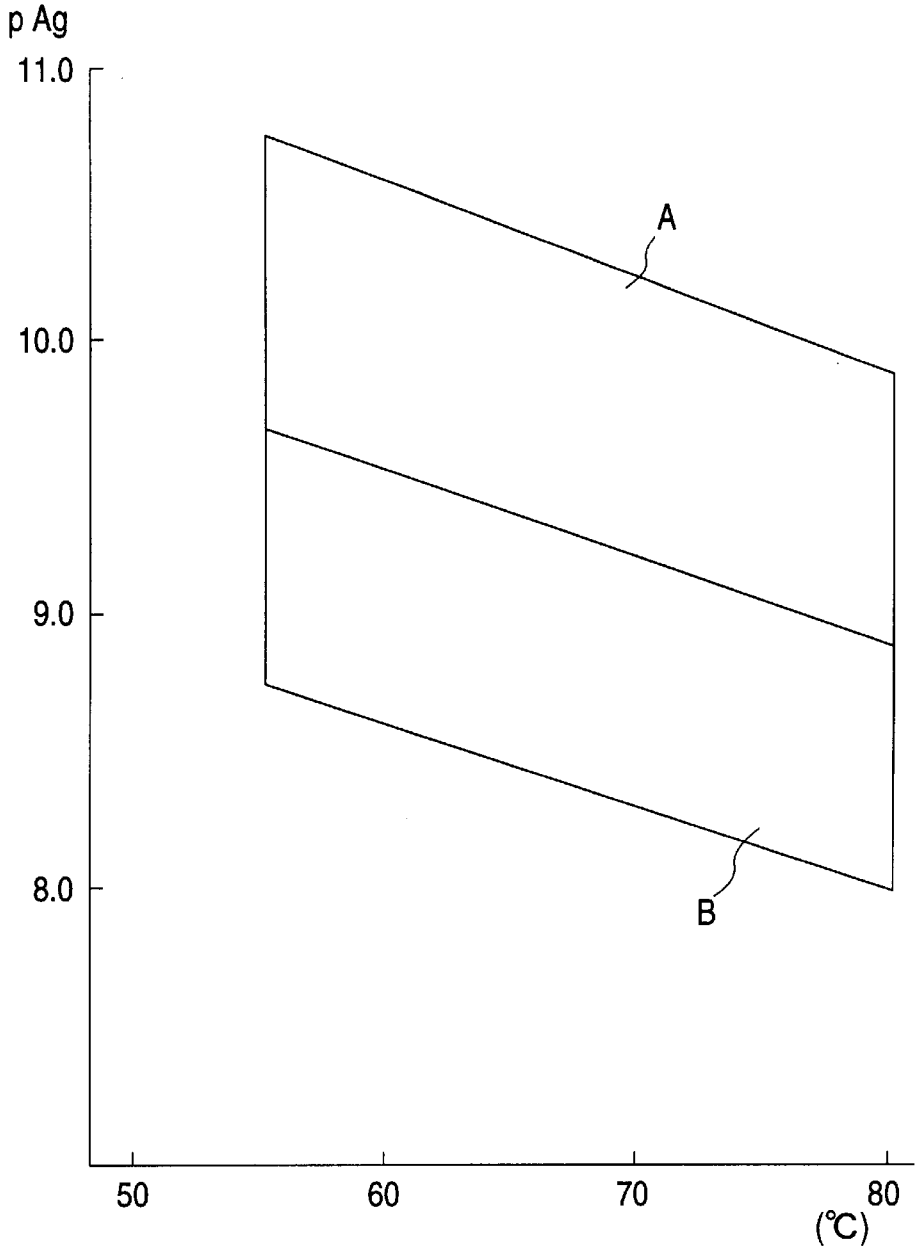
FIG. 3 is a diagram plotting pAg to temperatures (°C.); region A represents the temperature-pAg range optimally adopted in a dissolution step (step (b)), and region B represents the temperature-pAg range optimally adopted in a silver iodobromide thin layer forming step (step (c)) according to the present invention.

When an iodide ion is added in the present invention, it is preferably added on the conditions of the host emulsion within region A shown in FIG. 3 which is a diagram plotting pAg to temperatures (°C.) (on the lines or within the region surrounded by four lines connecting in order four points represented by (temperature, pAg) (55, 9.66), (55, 10.74), (80, 8.87) and (80, 9.85)). Herein, pAg is the logarithm of the reciprocal of the ion concentration of $Ag^+$ of the reaction system. Further, within region A, the region of higher temperature and higher pAg is more preferred. That is, the effect of the present invention is more effectively manifested in the region where the solubility of hardly soluble silver halide host grain in the reaction solution is extremely high.

As the function of temperature, when the temperature of the reaction solution is less than 55° C., effective dissolution according to the present invention is difficult to occur. Further, even when it is 55° C. or more, if the pAg in the reaction solution system is in the lower region than region A, effective dissolution is difficult to occur. In such cases, the local epitaxial formation of silver iodide orthe deposition and lamination of silver iodobromide on the grain are often observed.

In the present invention, host grains having a prescribed silver iodide content can be converted to the substrate grains of the shape unlimitedly approaching to a cylinder by the complete dissolution of the periphery of hexagonal or triangular grains by the addition of an iodide ion, but it is more preferred to conduct the above conversion within a predetermined temperature-pAg range to exhibit the above-described effect of the present invention. This is very important process to form dislocation lines in silver halide grains and will be described later.

The silver iodobromide thin layer forming step (step c)) is described in detail below.

It is presumed that the iodide ion added in Process b is present as the iodide ion in the reaction solution or precipitated as silver iodide or silver iodobromide containing 40 mol % silver iodide of almost solid solubility limit on the host grain. These are present in an equilibrium condition.

This equilibrium condition is controlled by the relationship of the temperature of the reaction solution and the concentration of the halide ion present.

In the present invention, the iodide ion is recrystallized and deposited on the host tabular grain as silver iodobromide, making supply source of this iodide ion or silver iodide or silver iodobromide on the host grain in the equilibrium condition, with the aid of an aqueous solution of a silver salt added from the outside of the reaction system.

The formation of silver iodobromide thin layer in the present invention is preferably conducted within region B shown in FIG. 3 which is a diagram shown by the functions of temperatures and pAg (on the lines or within the region surrounded by four lines connecting in order four points represented by (temperature, pAg) (55, 8.74), (55, 10.74), (80, 8.00) and (80, 9.85)). When a silver iodobromide thin layer is formed within this preferred temperature-pAg range, it is preferred to add a bromide ion with the addition of an aqueous solution of a silver salt in a corresponding degree. This preferred embodiment of the present invention is outside of the temperature-pAg range disclosed in the above JP-A-3-136032 and JP-A-3-136033.

There are cases where silver halide tabular grains prepared according to steps (a), (b) and (c) of the present invention have dislocation lines.

Tabular grains accounting for 60% or more of the entire silver halide grains prepared according to the present invention preferably have dislocation lines within the region from the outer circumference of the silver halide grain the periphery of which is completely dissolved in Step (b) to the position where a silver iodobromide thin layer is formed in step (c) as shown in FIG. 1.

Dislocation lines may be formed, other than the above position, over the region inclusive of the center part of two major faces parallel to each other of a tabular grain. When dislocation lines are formed over the entire region of the major faces, when viewed from the vertical direction to the major face of the grain, the directions of these dislocation lines are sometimes about the (211) directions crystallographically, but there are other cases such as in which the directions of dislocation lines are (110) directions or formed at random. Further, the length of each dislocation line is also variously different and there are a case where dislocation lines are observed on the major face as short lines, and a case where dislocation lines are observed as long lines arriving to the side (outer circumference). Dislocation lines are sometimes straight lines and sometimes snaking. Further, in many cases, they are mingling with each other and forming network-like dislocation lines.

The dislocation lines of tabular grains can be observed directly with the transmission type electron microscope at low temperature as disclosed, for example, in J. F. Hamilton, *Phot. Sci. Eng.*, vol. 11, p. 57 (1967) and T. Shiozawa, *J. Soc. Phot. Sci. Japan*, vol. 35, p. 213 (1972). That is, the silver halide grains taken out from the emulsion with a care so as not to apply such a pressure as generates dislocation lines on the grains are put on a mesh for observation by an electron microscope, and observation is conducted by a transmission method with the sample being in a frozen state so as to prevent the injury by an electron beam (e.g., printout). At this time, the thicker the thickness of the grain, the more difficult is the electron beam to be transmitted. Accordingly, it is preferred to use a high voltage electron microscope (200 kV or more with the grains of the thickness of 0.25 $\mu$m) for observing clearly. When viewed from the vertical direction to the major face of the grain by the photograph of the grains obtained as described above, the place of dislocation lines in each grain can be obtained.

Further, since the dislocation lines can be seen or cannot be seen according to the inclination angle of the sample to the electron beam, it is necessary to detect the existing positions of dislocation lines by observing the photographs of the same grain taken at different angles as many as possible to make a thorough observation of dislocation lines. In the present invention, the existing posotions and the number of dislocation lines were pursued by photographing five kinds of photographs of the grain with respect to the same grain with changing the inclination angle at 5° step using a high voltage electron microscope.

Figure 2:
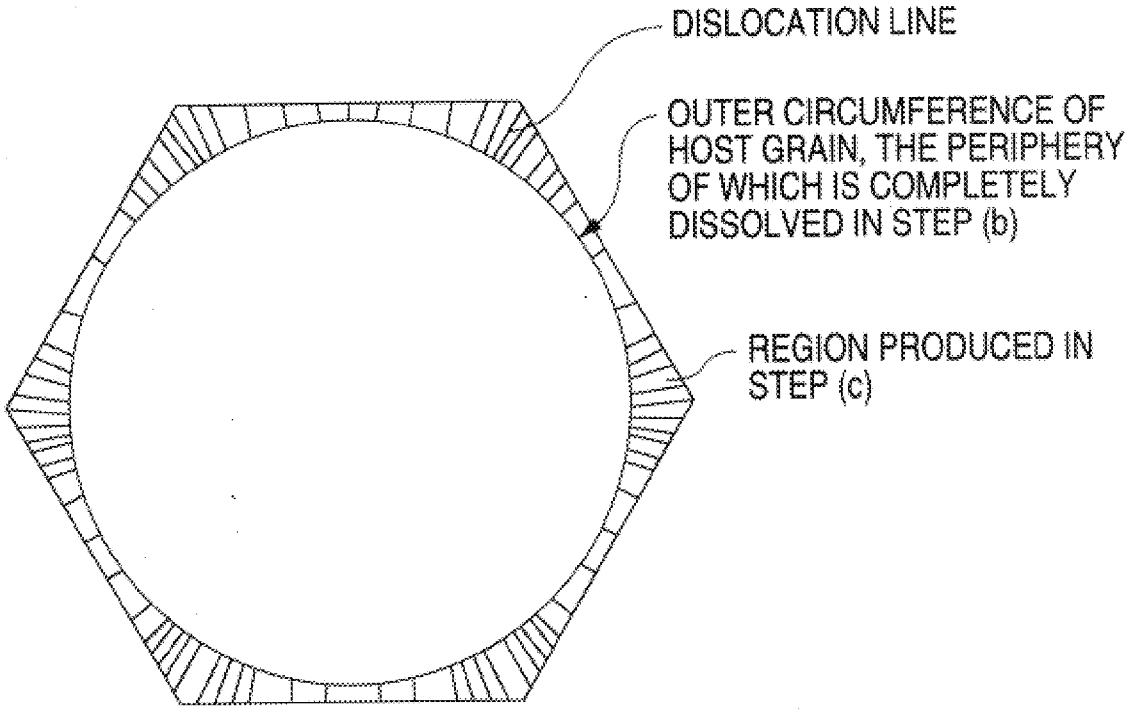
FIG. 2 is a drawing of the silver halide grain of the photograph in FIG. 1.

FIG. 1 is a high voltage electron microphotograph of a grain produced according to the present invention, and FIG. 2 is a drawing of the grain of the photograph in FIG. 1.

In the present invention, host grains can be converted to the substrate grains of a shape unlimitedly approaching to a cylinder by the complete dissolution of the periphery of hexagonal (or triangular) grains by the addition of an iodide ion. In FIG. 1, the remaining prototype of the substrate grain of a cylindrical shape having a boundary line on the circle can be observed. Thereafter, the reclaimed hexagonal shape by recrystallization in the silver iodo-bromide thin layer forming step can be observed. That is, the host grain the lateral sides of which were completely dissolved in step (b) and the silver iodobromide thin layer formed in step (c) are present with a clear boundary.

Further, dislocation lines are formed in step (c) and, as shown in FIG. 2, high density dislocation lines are present in the region reclaimed in step (c). The lengths of these dislocation lines increase gradually from the center region of each side between vertexes of the hexagon toward the vertexes.

Dislocation lines are considered to be generated by the disagreement of the lattice constant of silver bromide containing silver iodide of the host grain which is dissolved to a cylindrical shape with the lattice constant of silver bromide containing high silver iodide in the hexagonal region (region of oblique lines in FIG. 2) which is reclaimed by recrystallization.

The tabular grains according to the present invention have such a characteristic as the lengths of dislocation lines in the region in the vicinity of the vertex are longer than those in the region on each side of a hexagon or triangle. This is because the highly active part of tabular grains, i.e., the highly soluble vertex region of tabular grains, are dissolved best. The tabular grains of the present invention are also characterized in that dislocation lines are present very densely.

The dislocation lines of the tabular grains of the present invention are apparently different in aspects from the dislocation lines shown in FIGS. 2 and 3 of JP-A-63-220238.

The dislocation lines shown in FIG. 1 of JP-A-3175440 are present only in the vicinity of the vertex of tabular grains, therefore, apparently differ in aspects from the dislocation lines of the tabular grains of the present invention.

While as for JP-A-3-136032 and JP-A-3-136033, there are no disclosures about dislocation lines.

This distribution conditions of the dislocation lines in grains are considered to effectively inhibit deterioration of degradation of photographic properties due to various stresses, but the details thereof have not been elucidated yet.

Gelatin is preferably used as a protective colloid at the time of preparation of the emulsion of the present invention and as a binder for other hydrophilic colloid layers, but other hydrophilic colloids can also be used.

Examples thereof include proteins such as gelatin derivatives, graft polymers of gelatin and other high polymers, albumin and casein; sugar derivatives such as cellulose derivatives such as hydroxyethyl cellulose, carboxymethyl cellulose, and cellulose sulfate, sodium alginate, and starch derivatives; and various kinds of synthetic hydrophilic high polymers of homopolymers or copolymers such as polyvinyl alcohol, partially acetalated polyvinyl alcohol, poly-N-vinylpyrrolidone, polyacrylic acid, polymethacrylic acid, polyacrylamide, polyvinylimidazole, and polyvinylpyrazole.

Acid-processed gelatin and enzyme-processed gelatin disclosed in *Bull. Soc. Sci. Photo. Japan*, No. 16, p. 30 (1966) can be used as well as lime-processed gelatin, and hydrolyzed product and enzyme decomposed product of gelatin can also be used.

The emulsion of the present invention is preferably washed with water for the purpose of desalting and dispersed in a newly prepared protective colloid. The washing temperature can be selected according to the purpose but is preferably from 5 to 50° C. The pH at washing time can also be selected according to the purpose but is preferably from 2 to 10, more preferably from 3 to 8. The pAg at washing time can also be selected according to the purpose but is preferably from 5 to 10. The washing method can be selected from among a noodle washing method, a dialysis method using a semi-permeable membrane, a centrifugal separation method, a coagulation precipitation method, and an ion exchange method. In the case of a coagulation precipitation method, a washing method can be selected from among a method using sulfate, a method using an organic solvent, a method using a water-soluble polymer, a method using a gelatin derivative, etc.

Metal ion salts are preferably contained, according to purposes, in the emulsion of the present invention during emulsion preparation, e.g., at the time of grain formation, during desalting process, during chemical sensitization or before coating. When grains are doped with, the addition is preferably conducted during grain formation, and when ornamenting the surfaces of grains or using as a chemical sensitizer, it is preferably added after grain formation and before completion of chemical sensitization. A method of doping can be selected such that a grain is entirely doped or only a silver iodobromide thin layer part is doped. Examples of the metals which can be used include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, Bi, etc. These metals can be added if in the form of a salt, such as ammonium salt, acetate, nitrate, sulfate, phosphate, hydroxide, or a complex salt having six ligands or a complex salt having four ligands, which can be dissolved at the time of grain formation, for example, $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN_6]$, $K_3IrCl_6$, $(NH_4)_3RhCl_6$, $K_4Ru(CN)_6$, etc. A ligand of a coordination compound can be selected from halo, aquo, cyano, cyanate, thiocyanate, nitrosyl, thionitrosyl, oxo and carbonyl. They may comprise only one kind of a metal compound or may comprise two, three or more metal compounds in combination.

Metal compounds are preferably dissolved in water or an appropriate solvent such as methanol or acetone. For stabilizing the solution, a method of adding an aqueous solution of halogenated hydrogen (e.g., HCl, HBr) or an aqueous solution of alkali halide (e.g., KCl, NaCl, KBr, NaBr) to the solution can be used. Acid or alkali may be added, if desired. Metal compounds can be added to a reaction vessel before grain formation or may be added during grain formation. They also can be added to aqueous solutions of a water-soluble silver salt (e.g., $AgNO_3$) or an alkali halide (e.g., NaCl, KBr, KI) and added to a reaction solution continuously during silver halide grain formation. Further, they may be added as a separate solution independently from a water-soluble silver salt or an aqueous solution of alkali halide and added continuously at a proper time during grain formation. It is also preferred to use various addition methods in combination.

There are cases where a method in which the chalcogenide compounds as disclosed in U.S. Pat. No. 3,772,031 are added during the emulsion formation is useful. Cyanide, thiocyanide, selenocyanic acid, carbonate, phosphate and acetate can be present in addition to S, Se and Te.

The silver halide grains of the present invention can be subjected to at least one of sulfur sensitization, selenium sensitization, gold sensitization, palladium sensitization, noble metal sensitization and reduction sensitization during an optional stage of the production process of the silver halide emulsion. A combined use of two or more sensitizing methods is preferred. Various types of emulsions can be prepared depending upon the stages when the chemical sensitization is carried out. There are a type in which a chemically sensitized nucleus is buried in the internal part of a grain, a type in which a chemically sensitized nucleus is buried in the shallow part from the surface of a grain, or a type in which a chemically sensitized nucleus is formed on the surface of a grain. The emulsion of the present invention can select the position of a chemically sensitized nucleus according to the purpose, but it is generally preferred to have at least one chemically sensitized nucleus in the vicinity of the surface of a grain.

Chemical sensitizing methods which can be preferably conducted in the present invention include chalcogenide sensitization alone, noble metal sensitization alone and the combinations thereof, and these sensitizing methods can be carried out using active gelatin as disclosed in T. H. James, *The Theory of the Photographic Process*, 4th Ed., Macmillan, 1977, pp. 67 to 76, and also sensitization can be conducted using sulfur, selenium, tellurium, gold, platinum, palladium, or iridium, or two or more of these sensitizers in combination at pAg of from 5 to 10, pH of from 5 to 8, and temperature of from 30 to 80° C. as disclosed in *Research Disclosure,* Vol. 120, April, 1974, 12008, idib., Vol. 34, June, 1975, 13452, U.S. Pat. Nos. 2,642,361, 3,297,446, 3,772,031, 3,857,711, 3,901,714, 4,266,018 and 3,904,415 and British Patent 1,315,755. In noble metal sensitization, a noble metal salt such as gold, platinum, palladium and iridium can be used, and particularly preferred are gold sensitization, palladium sensitization, and the combined use of them.

In gold sensitization, known compounds such as chloroauric acid, potassium chloroaurate, potassium aurithiocyanate, gold sulfide and gold selenide can be used.

The palladium compound means 2-equivalent or 4-equivalent salt of palladium. Preferred palladium compound is represented by $R_2PdX_6$ or $R_2PdX_4$, wherein R represents a hydrogen atom, an alkali metal atom or an ammonium group; and X represents a halogen atom, e.g., chlorine, bromine or iodine. Specifically, $K_2PdCl_4$, $(NH_4)_2PdCl_6$, $Na_2PdCl_4$, $(NH_4)_2PdCl_4$, $Li_2PdCl_4$, $Na_2PdCl_6$ or $K_2PdBr_4$ is preferred. A gold compound and a palladium compound are preferably used in combination with thiocyanate or selenocyanate.

Hypo, thiourea based compounds, rhodanine based compounds, and the sulfur-containing compounds disclosed in U.S. Pat. Nos. 3,857,711, 4,266,018 and 4,054,457 can be used as a sulfur sensitizer.

Chemical sensitization can be conducted in the presence of a so-called auxiliary chemical sensitizer. The compounds known to inhibit fogging during chemical sensitization and to increase sensitivity, such as azaindene, azapyridazine, azapyrimidine, are used as a useful auxiliary chemical sensitizer. Examples of auxiliary chemical sensitizer reformer are disclosed in U.S. Pat. Nos. 2,131,038, 3,411,914, 3,554,751, 3,554,757, JP-A-58-126526 and G. F. Duffin, *Photographic Emulsion Chemistry*, pp. 138 to 143.

The emulsion of the present invention is preferably subjected to gold sensitization in combination. The amount of a gold sensitizer for use in the present invention is preferably from $1\times10^{-4}$ to $1\times10^{-7}$ mol, more preferably from $1\times10^{-5}$ to $5\times10^{-7}$ mol, per mol of the silver halide. The amount of a palladium compound for use in the present invention is preferably from $1\times10^{-3}$ to $5\times10^{-7}$ mol per mol of the silver halide. The amount of a thiocyanide compound or a selenocyanide compound is preferably from $5\times10^{-2}$ to $1\times10^{-6}$ mol per mol of the silver halide.

The amount of the sulfur sensitizer for use in the silver halide grains of the present invention is preferably from $1\times10^{-4}$ to $1\times10^{-7}$ mol, more preferably from $1\times10^{-5}$ to $5\times10^{-7}$ mol, per mol of the silver halide.

The emulsion of the present invention are preferably sensitized by a selenium sensitizing method. Known unstable selenium compounds are used in selenium sensitization, and specific examples thereof include selenium compounds such as colloidal metal selenium, selenoureas (e.g., N,N-dimethylselenourea, N,N-diethylselenourea), seleno ketones and selenoamides. There are cases where selenium sensitization is rather preferably conducted in combination with sulfur sensitization or noble metal sensitization or with both of them.

The silver halide emulsion of the present invention is preferably reduction sensitized during grain formation, or after grain formation and before chemical sensitization or during chemical sensitization, or after chemical sensitization.

The method of the reduction sensitization can be selected from a method in which a reduction sensitizer is added to a silver halide emulsion, a method in which grains are grown or ripened in the atmosphere of low pAg of from 1 to 7 which is called silver ripening, or a method in which grains are grown or ripened in the atmosphere of high pH of from 8 to 11 which is called high pH ripening. Further, two or more of these methods can be used in combination.

A method of adding a reduction sensitizer is preferred from the point of capable of delicately controlling the level of the reduction sensitization.

Stannous salt, ascorbic acid and derivatives thereof, amines and polyamines, hydrazine derivatives, formamidine-sulfinic acid, silane compounds and borane compounds are well known as a reduction sensitizer. These known reduction sensitizers can be selected and used in the present invention, and two or more of these compounds can also be used in combination. Stannous chloride, thiourea dioxide, dimethylamineborane, ascorbic acid and derivatives thereof are preferred compounds as a reduction sensitizer. As the addition amount of the reduction sensitizer depends upon the production conditions of the emulsion, the addition amount needs to be selected, but $10^{-7}$ to $10^{-3}$ mol per mol of the silver halide is preferred.

The reduction sensitizers are dissolved in water or a solvent such as alcohols, glycols, ketones, esters or amides and added during grain growth. The reduction sensitizers may be previously added to a reaction vessel, but the addition at proper time during grain growth is more preferred. Further, the reduction sensitizers have been previously added to an aqueous solution of water-soluble silver salt or an aqueous solution of water-soluble alkali halide and silver halide grains can be precipitated using these aqueous solutions. In addition, the solution of the reduction sensitizers may be divided to several parts and added in several times or may be added continuously over a long period of time with the degree of the grain growth.

It is preferred to use an oxidant for silver during the production process of the emulsion of the present invention. An oxidant for silver is a compound having a function of acting on metal silver and converting it to a silver ion. In particular, a compound which can convert superminute silver grains by-produced in the course of the formation of silver halide grains and chemical sensitization to a silver ion is effective. The silver ion converted may form hardly water-soluble silver salt such as silver halide, silver sulfide or silver selenide, or may form easily water-soluble silver salt such as silver nitrate. An oxidant for silver may be inorganic or organic. Examples of inorganic oxidants include oxyacid salt, such as ozone, hydrogen peroxide and addition products thereof (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$), peroxyacid salt (e.g., $K_2S_2O_8$, $K_2C_2O_6$, $K_2P_2O_8$), peroxy complex compound (e.g., $K_2[Ti(O_2)C_2O_4].3H_2O$, $4K_2SO_4.Ti(O_2)OH.SO_4.2H_2O$, $Na_3[VO(O_2)\ (C_2H_4)_2].6H_2O$), permanganate (e.g., $KMnO_4$), and chromate (e.g., $K_2Cr_2O_7$), halogen element such as iodine and bromine, perhalogen acid salt (e.g., potassium periodate), salt of metal of high valency (e.g., potassium hexacyanoferrate-(III)), and thiosulfonate.

Further, examples of organic oxidants include quinones such as p-quinone, organic peroxide such as peracetic acid and perbenzoic acid, a compound which releases active halogen (e.g., N-bromosuccinimide, chloramine T, chloramine B).

The oxidants which are preferably used in the present invention are inorganic oxidants such as ozone, hydrogen peroxide and addition products thereof, halogen element, thiosulfonate, and organic oxidants such as quinones. It is preferred to use the above described reduction sensitization in combination with an oxidant for silver. The method of usage can be selected from a method in which an oxidant is used and then reduction sensitization is carried out, an inverse method thereof, or a method in which both are concurred with. These methods can be selectively used in a grain forming process and a chemical sensitization process.

The photographic emulsion for use in the present invention can contain various compounds for preventing fogging during manufacture of the photographic material, during storage, or during photographic processing, or for stabilizing photographic capabilities. That is, many compounds known as antifoggants and stabilizers can be incorporated into the emulsion, for example, thiazoles, e.g., benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole); mercaptopyrimidines; mercaptotriazines; thioketo compounds, e.g., oxazolinethione; and azaindenes, e.g., triazaindenes, tetraazaindenes (in particular, 4-hydroxy-substituted(1,3,3a,7)tetraazaindenes), and pentaazaindenes. For example, the compounds disclosed in U.S. Pat. Nos.

3,954,474, 3,982,947, JP-B-52-28660 (the term "JP-B" as used herein means an "examined Japanese patent publication") can be used. One preferred compound is the compound disclosed in JP-A-63-212932. Antifoggants and stabilizers can be added to the emulsion according to the purpose at any time before grain formation, during grain formation, after grain formation, during washing process, at the time of dispersion after washing, before chemical sensitization, during chemical sensitization, after chemical sensitization, and before coating. They are added during emulsion preparation for various purposes of, in addition to their original functions of prevention of fogging and stabilization of photographic capabilities, controlling crystal habit of grains, decreasing the grain size, reducing the solubility of grains, controlling chemical sensitization, or controlling arrangement of dyes.

The photographic emulsion for use in the present invention is preferably spectrally sensitized with methine dyes and the like to exhibit the effects of the present invention. The dyes which are used include a cyanine dye, a merocyanine dye, a complex cyanine dye, a complex merocyanine dye, a holopolar cyanine dye, a hemicyanine dye, a styryl dye, and a hemioxonol dye. Particularly useful dyes are dyes belonging to a cyanine dye, a merocyanine dye and a complex merocyanine dye. Nuclei which are usually utilized as basic heterocyclic nuclei in cyanine dyes can be applied to these dyes. For example, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus; the above nuclei to which alicyclic hydrocarbon rings are fused; the above nuclei to which aromatic hydrocarbon rings are fused, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus can be applied. These heterocyclic nuclei may be substituted on the carbon atoms.

As a nucleus having a ketomethylene structure, a 5- or 6-membered heterocyclic nucleus such as a pyrazolin-5-one nucleus, a thiohydantoin nucleus, a 2-thiooxazolidine-2,4-dione nucleus, a thiazolidine-2,4-dione nucleus, a rhodanine nucleus, or a thiobarbituric acid nucleus can be applied to a merocyanine dye or a complex merocyanine dye.

These sensitizing dyes may be used alone or in combination. A combination of sensitizing dyes is often used for the purpose of supersensitization. Examples thereof are disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Patents 1,344,281, 1,507,803, JP-B-43-4936, JP-B-53-12375, JP-A-52-110618 and JP-A-52-109925.

Further, dyes which themselves do not have a spectral sensitizing function or substances which substantially do not absorb visible light but show supersensitization can be incorporated into the emulsion with sensitizing dyes.

Sensitizing dyes may be added to the emulsion at any stage of the preparation of the emulsion hitherto known to be useful. In general, it is conducted during the period after the completion of chemical sensitization and before coating, however, a method in which sensitizing dyes are added at the same time with the addition of chemical sensitizers and spectral sensitization is carried out simultaneously with chemical sensitization can be employable as disclosed in U.S. Pat. Nos. 3,628,969 and 4,225,666, further, as disclosed in JP-A-58-113928, spectral sensitization can be conducted prior to chemical sensitization, or sensitizing dyes can be added and spectral sensitization can be started before completion of the precipitation formation of the silver halide grains. Still further, as disclosed in U.S. Pat. No. 4,225,666, sensitizing dyes can be divided and added separately, that is, a part of them is added prior. to chemical sensitization and the remaining is added after chemical sensitization, therefore, any time during silver halide grain formation is feasible, as well as the method disclosed in U.S. Pat. No. 4,183,756.

A sensitizing dye can be added in an amount of from $4\times10^{-6}$ to $8\times10^{-3}$ mol per mol of the silver halide, but in the case of more preferred silver halide grain size of from 0.2 to 1.2 $\mu$m, the amount of from $5\times10^{-5}$ to $2\times10^{-3}$ mol per mol of the silver halide is more preferred.

The above-described various additives are used in photographic materials according to the present invention but various other additives can be used according to the purpose.

These additives are disclosed in detail in *Research Disclosure*, Item 17643 (December, 1978), ibid., Item 18716 (November, 1979) and ibid., Item 308119 (December, 1989). The locations corresponding thereto are indicated in the table below.

| | Type of Additives | RD 17643 | RD 18716 | RD 308119 |
|---|---|---|---|---|
| 1. | Chemical Sensitizers | page 23 | page 648, right column | page 996 |
| 2. | Sensitivity Increasing Agents | — | page 648, right column | — |
| 3. | Spectral Sensitizers and Supersensitizers | pages 23–24 | page 648, right column to page 649, right column | page 996, right column to page 998 right column |
| 4. | Brightening Agents | page 24 | page 647, right column | page 998, right column |
| 5. | Antifoggants and Stabilizers | pages 24–25 | page 649, right column | page 998, right column to page 1000, right column |

-continued

| | Type of Additives | RD 17643 | RD 18716 | RD 307105 |
|---|---|---|---|---|
| 6. | Light Absorbers, Filter Dyes, and Ultraviolet Absorbers | pages 25–26 | page 649, right column to page 650, left column | page 1003, left column to page 1003, right column |
| 7. | Antistaining Agents | page 25, right column | page 650, left to right columns | page 1002, right column |
| 8. | Dye image Stabilizers | page 25 | — | page 1002, right column |
| 9. | Hardening Agents | page 26 | page 651, left column | page 1004, right column to page 1005, left column |
| 10. | Binders | page 26 | page 651, left column | page 1003, left column to page 1004, right column |
| 11. | Plasticizers and Lubricants | page 27 | page 650, right column | page 1006, left column to page 1006 right column |
| 12. | Coating Aids and Surfactants | pages 26–27 | page 650, right column | page 1005, left column to page 1006, left column |
| 13. | Antistatic Agents | page 27 | page 650, right column | page 1006, right column to page 1007, left column |
| 14. | Matting Agents | — | — | page 1008, left column to page 1009, left column |

The emulsion of the present invention, and techniques such as layer arrangement, silver halide emulsion, functional couplers such as dye-forming couplers and DIR couplers, various additives and the like and development processing which can be used in the photographic material using the emulsion of the present invention are disclosed in EP-A-565096 (published on Oct. 13, 1993) and the patents cited therein. Each item and corresponding locations are listed below.

| | | |
|---|---|---|
| 1. | Layer Structures | lines 23 to 35, page 61, line 41, page 61 to line 14, page 62 |
| 2. | Interlayers | lines 36 to 40, page 61 |
| 3. | Interlayer Effect Donating Layers | lines 15 to 18, page 62 |
| 4. | Halide Compositions of Silver Halide | lines 21 to 25, page 62 |
| 5. | Crystal Habits of Silver Halide Grains | lines 26 to 30, page 62 |
| 6. | Grain Sizes of Silver Halide Grains | lines 31 to 34, page 62 |
| 7. | Producing Methods of Emulsions | lines 35 to 40, page 62 |
| 8. | Grain Size Distributions of Silver Halide Grains | lines 41–42, page 62 |
| 9. | Tabular Grains | lines 43 to 46, page 62 |

-continued

| | | |
|---|---|---|
| 10. | Structures of Interiors of Grains | lines 47 to 53, page 62 |
| 11. | Latent Image Forming Types of Emulsions | line 54, page 62 to line 5, page 63 |
| 12. | Physical Ripening and Chemical Ripening of Emulsions | lines 6 to 9, page 63 |
| 13. | Mixed Usage of Emulsions | lines 10 to 13, page 63 |
| 14. | Fogged Emulsions | lines 14 to 31, page 63 |
| 15. | Light-Insensitive Emulsions | lines 32 to 43, page 63 |
| 16. | Coating Amount of Silver | lines 49 and 50, page 63 |
| 17. | Photographic Additives | disclosed in Research Disclosure, Item 17643 (Dec., 1978), ibid., Item 18716 (Nov., 1979) and ibid., Item 307105 (Nov., 1989) and the locations related thereto are indicated below |

| | Type of Additives | RD 17643 | RD 18716 | RD 307105 |
|---|---|---|---|---|
| 1) | Chemical Sensitizers | page 23 | page 648, right column | page 866 |
| 2) | Sensitivity Increasing Agents | — | page 648, right column | — |
| 3) | Spectral Sensitizers and Supersensitizers | pages 23–24 | page 648, right column to page 649, right column | pages 866–868 |
| 4) | Brightening Agents | page 24 | page 647, right column | page 868 |
| 5) | Antifoggants and Stabilizers | pages 24–25 | page 649, right column | pages 868-870 |
| 6) | Light Absorbers, Filter Dyes, and Ultraviolet Absorbers | pages 25–26 | page 649, right column to page 650, left column | page 873 |
| 7) | Antistaining Agents | page 25, right column | page 650, left to right columns | page 872 |
| 8) | Dye image Stabilizers | page 25 | page 650, left column | page 872 |
| 9) | Hardening Agents | page 26 | page 651, left column | pages 874–875 |
| 10) | Binders | page 26 | page 651, left column | pages 873–874 |
| 11) | Plasticizers and Lubricants | page 27 | page 650, right column | page 876 |
| 12) | Coating Aids and Surfactants | pages 26–27 | page 650, right column | pages 875–876 |
| 13) | Antistatic Agents | page 27 | page 650, right column | pages 876–877 |
| 14) | Matting Agents | — | — | pages 878–879 |

| | | |
|---|---|---|
| 18. | Formaldehyde Scavengers | lines 54 to 57, page 64 |
| 19. | Mercapto-Based Antifoggants | lines 1 and 2, page 65 |
| 20. | Releasing Agents of Antifoggants and the like | lines 3 to 7, page 65 |
| 21. | Dyes | lines 7 to 10, page 65 |
| 22. | Color Couplers in General | lines 11 to 13, page 65 |
| 23. | Yellow, Magenta and Cyan Couplers | lines 14 to 25, page 65 |
| 24. | Polymer Couplers | lines 26 to 28, paqe 65 |
| 25. | Diffusible Dye-Forming Couplers | lines 29 to 31, page 65 |
| 26. | Colored Couplers | lines 32 to 38, page 65 |
| 27. | Functional Couplers in General | lines 39 to 44, page 65 |
| 28. | Bleaching Accelerator-Releasing Couplers | lines 45 to 48, page 65 |
| 29. | Development Accelerator-Releasing Couplers | lines 49 to 53, page 65 |
| 30. | Other DIR Couplers | line 54, page 65 to line 4, page 66 |
| 31. | Methods of Coupler Dispersion | lines 5 to 28, page 66 |
| 32. | Preservatives, Antibacterial Agents | lines 29 to 33, page 66 |
| 33. | Kinds of Photographic Materials | lines 34 to 36, page 66 |
| 34. | Film Thickness of Light-Sensitive Layer and Film Swelling Rate | line 40, page 66 to line 1, page 67 |
| 35. | Backing Layers | lines 3 to 8, page 67 |
| 36. | Development Processing in General | lines 9 to 11, page 67 |
| 37. | Developing Solutions and Developing Agents | lines 12 to 30, page 67 |

-continued

| | | |
|---|---|---|
| 38. | Additives for Developing Solution | lines 31 to 44, page 67 |
| 39. | Reversal Process | lines 45 to 56, page 67 |
| 40. | Open Factor of Processing Solutions | line 57, page 67 to line 12, page 68 |
| 41. | Developing Time | lines 13 to 15, page 68 |
| 42. | Bleach-Fixing, Bleaching and Fixing | line 16, page 68 to line 31, page 69 |
| 43. | Automatic Processors | lines 32 to 40, page 69 |
| 44. | Washing, Rinsing and Stabilization | line 41, page 69 to line 18, page 70 |
| 45. | Replenishment of Processing Solutions and Reuse | lines 19 to 23, page 70 |
| 46. | Incorporation of Developing Agent in Photographic Material | lines 24 to 33, page 70 |
| 47. | Temperature of Development Processing | lines 34 to 38, page 70 |
| 48. | Use in Film Equipped with Lens | lines 39 to 41, page 70 |

In addition, bleaching solutions containing ferric salt and persulfate such as 2-pyridinecarboxylic acid or 2,6-pyridinedicarboxylic acid with ferric nitrate as disclosed in European Patent 602600 can also be preferably used. When using these bleaching solutions, it is preferred to use a stopping process and a washing process between a color developing process and a bleaching process, and an organic acid such as acetic acid, succinic acid, or maleic acid is preferably used in a stopping solution. In addition, it is preferred for such bleaching solutions to contain an organic acid such as acetic acid, succinic acid, maleic acid, glutaric acid, or adipic acid in an amount of from 0.1 to 2 mol/liter for the purpose of pH adjustment and bleaching fog.

The present invention will be illustrated in more detail with reference to examples below, but the present invention is not construed as being limited thereto.

EXAMPLE 1

Preparation of Emulsion

Preparation of Tabular Seed Crystal A

An aqueous solution (1,600 ml) containing 4.5 g of KBr and 7.9 g of gelatin having an average molecular weight of 15,000 was stirred while maintaining the temperature at 40° C. To the aqueous solution, an aqueous solution containing 8.9 g of silver nitrate and an aqueous solution of KBr (6.2 g) containing 18.9 wt% of KI were added by a double jet method for 40 seconds. After 38 g of gelatin was added thereto, the temperature was raised to 58° C. An aqueous solution containing 1.9 g of silver nitrate was added thereto, then 0.05 mol of ammonia was added, and 15 minutes after, pH was adjusted to 5.0 with acetic acid. Subsequently, an aqueous solution containing 219 g of silver nitrate and an aqueous solution containing KBr were added by a double jet method for 40 minutes with increasing the feed rate and maintaining the pAg in the solution at 8.2. After the completion of the addition, the temperature was lowered to 40° C., and the reaction mixture was washed with water and desalted, then 50 g of gelatin was added and pH was adjusted to 5.8 and pAg to 8.8 at 40° C.

This seed crystal emulsion contained tabular grains containing 0.5 mol % of silver iodide, 1.2 mol per kg of the emulsion of Ag, 60 g of gelatin, and having average diameter corresponding to circle of 0.35 μm, variation coefficient corresponding to circle of 16%, average thickness of 0.09 μm and average aspect ratio of 3.9.

Preparation of Tabular Seed Crystal B

Seed crystal B was prepared in the same manner as the preparation of seed crystal A except that pAg in the solution was maintained at 9.1 at the time of addition by a double jet method by accelerated feed rate.

This seed crystal emulsion contained tabular grains containing 0.5 mol % of silver iodide, 1.2 mol per kg of the emulsion of Ag, 60 g of gelatin, and having average diameter corresponding to circle of 0.40 μm, variation coefficient corresponding to circle of 20%, average thickness of 0.06 μm and average aspect ratio of 6.7.

Preparation of Emulsion Em-1

1,200 ml of an aqueous solution containing 1.2 g of potassium bromide and 33 g of gelatin was stirred while maintaining the temperature at 75° C. After 34 g of silver bromide tabular seed crystal A was added, an aqueous solution containing 142.3 g of silver nitrate and 566 ml of an aqueous solution of halide containing 103 g of potassium bromide and 9.5 g of potassium iodide were added by a double jet method for 45 minutes with increasing the feed rate and maintaining the pAg in the solution at 8.0. After the completion of addition, the temperature was lowered to 55° C., the pAg in the solution at this time was 8.90. After 100 ml of an aqueous solution containing 10 g of silver nitrate and 540 ml of an aqueous solution containing 9.0 g of potassium iodide were added by a double jet method for 5 minutes with maintaining the feed rate constant, pAg was adjusted to 9.3. Further, an aqueous solution containing 63 g of silver nitrate and an aqueous solution containing 43 g of potassium bromide were added by a double jet method and the reaction solution was cooled. After washing the solution with water, gelatin was added at 40° C. and pH was adjusted to 5.8 and pAg to 8.8.

This emulsion contained tabular silver iodobromide grains having average diameter corresponding to circle of 1.2 μm, variation coefficient corresponding to circle of 22%, average thickness of 0.28 μm, average aspect ratio of 4.3 and total silver iodide content of 8.8 mol %.

Preparation of Emulsion Em-2

1,200 ml of an aqueous solution containing 1.2 g of potassium bromide and 33 g of gelatin was stirred while maintaining the temperature at 75° C. After 34 g of silver bromide tabular seed crystal A was added, an aqueous solution containing 142.3 g of silver nitrate and 566 ml of an aqueous solution of halide containing 107 g of potassium bromide and 4.2 g of potassium iodide were added by a double jet method for 60 minutes with increasing the feed rate and maintaining the pAg in the solution at 7.7.

The temperature of the above emulsion was lowered to 55° C., and pAg was adjusted to 8.75 with an aqueous solution containing 30 wt% of potassium bromide. Then, 540 ml of an aqueous solution containing 9.0 g of potassium iodide was added for 5 minutes with maintaining the feed rate constant, and stirring was continued for further 2 minutes. pAg at this time was 9.4.

Further, 250 ml of an aqueous solution containing 73 g of silver nitrate and 180 ml of an aqueous solution containing 43 g of potassium bromide were added to the above emulsion by a double jet method and the reaction mixture was cooled. After washing the mixture with water, gelatin was added at 40° C. and pH was adjusted to 5.8 and pAg to 8.8.

This emulsion contained tabular silver iodobromide grains having average diameter corresponding to circle of 1.00 μm, variation coefficient corresponding to circle of 16%, average thickness of 0.33 μm, average aspect ratio of 3.0 and total silver iodide content of 5.9 mol %.

Preparation of Emulsion Em-3 a) Preparation of Host Tabular Grains 1,200 ml of an aqueous solution containing 1.2 g of potassium bromide and 33 g of gelatin was stirred while maintaining the temperature at 75° C. After 34 g of silver bromide tabular seed crystal B was added, 670 ml of an aqueous solution containing 142.3 g of silver nitrate and 566 ml of an aqueous solution of halide containing 107 g of potassium bromide and 4.2 g of potassium iodide were added by a double jet method for 45 minutes with increasing the feed rate and maintaining the pAg in the solution at 8.0.

b) Dissolution by Addition of Iodide Ion

The temperature of the above emulsion was lowered to 55° C., pAg at this time was 8.9. Then, 540 ml of an aqueous solution containing 9.0 g of potassium iodide was added for 5 minutes with maintaining the feed rate constant, and stirring was continued for further 2 minutes. pAg was adjusted to 8.9 at this time with an aqueous solution containing 1.0 wt% of silver nitrate.

c) Formation of Silver Iodobromide Thin Layer

Further, 250 ml of an aqueous solution containing 73 g of silver nitrate and 180 ml of an aqueous solution containing 43 g of potassium bromide were added to the above emulsion by a double jet method while maintaining pAg at 8.9 and the reaction mixture was cooled. After washing the mixture with water, gelatin was added at 40° C. and pH was adjusted to 5.8 and pAg to 8.8.

Preparation of Emulsion Em-4 a) Preparation of Host Tabular Grains 1,200 ml of an aqueous solution containing 1.2 g of potassium bromide and 33 g of gelatin was stirred while maintaining the temperature at 65° C. After 34 g of silver bromide tabular seed crystal B was added, 670 ml of an aqueous solution containing 142.3 g of silver nitrate and 566 ml of an aqueous solution of halide containing 107 g of potassium bromide and 4.2 g of potassium iodide were added by a double jet method for 45 minutes with increasing the feed rate and maintaining the pAg in the solution at 8.0.

b) Dissolution by Addition of Iodide Ion

An aqueous solution containing 30 wt % of potassium bromide was added to the above emulsion and pAg was adjusted to 9.78. Then, 840 ml of an aqueous solution containing 9.0 g of potassium iodide was added for 20 minutes with maintaining the feed rate constant, and stirring was continued for further 2 minutes. pAg at this time was 9.58.

c) Formation of Silver Iodobromide Thin Layer

Further, 250 ml of an aqueous solution containing 73 g of silver nitrate was added to the above emulsion with maintaining the feed rate constant and the reaction mixture was cooled. After washing the mixture with water, gelatin was added at 40° C. and pH was adjusted to 5.8 and pAg to 8.8.

Preparation of Emulsion Em-5 a) Preparation of Host Tabular Grains 1,200 ml of an aqueous solution containing 1.2 g of potassium bromide and 33 g of gelatin was stirred while maintaining the temperature at 75° C. After 34 g of silver bromide tabular seed crystal B was added, 670 ml of an aqueous solution containing 142.3 g of silver nitrate and 566 ml of an aqueous solution of halide containing 107 g of potassium bromide and 4.2 g of potassium iodide were added by a double jet method for 45 minutes with increasing the feed rate and maintaining the pAg in the solution at 8.0.

b) Dissolution by Addition of Iodide Ion

An aqueous solution containing 30 wt % of potassium bromide was added to the above emulsion and pAg was adjusted to 9.2. Then, 840 ml of an aqueous solution containing 9.0 g of potassium iodide was added for 20 minutes with maintaining the feed rate constant, and stirring was continued for further 2 minutes. pAg at this time was 9.38.

c) Formation of Silver Iodobromide Thin Layer

Further, 250 ml of an aqueous solution containing 73 g of silver nitrate was added to the above emulsion with maintaining the feed rate constant and the reaction mixture was cooled. After washing the mixture with water, gelatin was added at 40° C. and pH was adjusted to 5.8 and pAg to 8.8.

Preparation of Emulsion Em-6 a) Preparation of Host Tabular Grains 1,200 ml of an aqueous solution containing 1.2 g of potassium bromide and 33 g of gelatin was stirred while maintaining the temperature at 75° C. After 34 g of silver bromide tabular seed crystal B was added, 440 ml of an aqueous solution containing 94.3 g of silver nitrate and 480 ml of an aqueous solution of halide containing 72 g of potassium bromide and 2.72 g of potassium iodide were added by a double jet method for 40 minutes with increasing the feed rate and maintaining the pAg in the solution at 8.0.

Then, 300 ml of an aqueous solution containing 48 g of silver nitrate and 155 ml of an aqueous solution containing 38 g of potassium bromide were added by a double jet method for 10 minutes while maintaining the pAg in the solution at 8.0 and maintaining the feed rate constant.

b) Dissolution by Addition of Iodide Ion

An aqueous solution containing 30 wt % of potassium bromide was added to the above emulsion and pAg was adjusted to 9.2. Then, 840 ml of an aqueous solution containing 14.6 g of potassium iodide was added for 20 minutes with maintaining the feed rate constant, and stirring was continued for further 2 minutes. pAg at this time was 9.42.

c) Formation of Silver Iodobromide Thin Layer

Further, 250 ml of an aqueous solution containing 73 g of silver nitrate was added to the above emulsion with maintaining the feed rate constant and the reaction mixture was cooled. After washing the mixture with water, gelatin was added at 40° C. and pH was adjusted to 5.8 and pAg to 8.8.

Preparation of Emulsion Em-7

Em-7 was prepared in the same manner as the preparation of Em-6 except that dissolution by the addition of iodide ion b) was changed as follows.

Dissolution by Addition of Iodide Ion

An aqueous solution containing 30 wt % of potassium bromide was added to the above host emulsion and pAg was adjusted to 9.2. Then, 840 ml of an aqueous solution containing 5.0 g of potassium iodide was added for 20 minutes with maintaining the feed rate constant, and stirring was continued for further 2 minutes. pAg at this time was 9.35.

Emulsions Em-3 to Em-7 were tabular silver iodobromide grains having average diameter corresponding to circle of 1.38 $\mu$m, variation coefficient corresponding to circle of 25%, average thickness of 0.23 $\mu$m, average aspect ratio of 6.0 and total silver iodide content of 5.9 mol %.

The temperature of each of the above-obtained tabular silver halide emulsions Em-1 to Em-7 was raised to 59° C., dipotassium hexachloroiridate, sensitizing dyes ExS-4, ExS-7 and ExS-8 shown below, sodium thiosulfate, chloroauric acid, potassium thiocyanate and N,N'-dimethylselenourea were added and chemical sensitization was carried out optimally. The term "optimally" as used herein means the condition by which the highest sensitivity is obtained by 1/100 seconds exposure.

Photographic properties of the thus-obtained emulsions Em-1 to Em-7 are summarized in Table 1 below.

TABLE 1

| Emulsion No. | Final Grain: Diameter Corresponding to Circle (μm) | Final Grain: Content of Silver Iodide (mol %) | Final Grain: Aspect Ratio | Host Emulsion: Silver Iodide Content $I_1$ (mol %) | Host Emulsion: Silver Iodide Content in Outermost Nuclear Layer (mol %) | Condition od Process b: Temperature (° C.) | Condition od Process b: When Iodide Was Added | Condition od Process b: Amount Added of Iodide to Host Grain $I_2$ (mol %) | Condition of Process c: Temperature (° C.) | Condition of Process c: pAg from Start to Completion | Remarks |
|---|---|---|---|---|---|---|---|---|---|---|---|
| Em-1 | 1.20 | 8.8 | 4.3 | 9.4 | — | 55 | 8.90 | 6.5 | 55 | 9.3–9.0 | Comparison |
| Em-2 | 1.00 | 5.9 | 3.0 | 3.0 | — | 55 | 8.75 | 6.5 | 55 | 9.4–8.4 | " |
| Em-3 | 1.38 | 5.9 | 6.0 | 3.4 | — | 55 | 8.90 | 6.5 | 55 | 8.9–8.9 | " |
| Em-4 | 1.38 | 5.9 | 6.0 | 3.4 | — | 65 | 9.78 | 6.5 | 65 | 9.6–8.4 | Invention |
| Em-5 | 1.38 | 5.9 | 6.0 | 6.4 | — | 75 | 9.20 | 6.5 | 75 | 9.4–8.4 | " |
| Em-6 | 1.38 | 8.0 | 6.0 | 2.2 | 0.0 | 75 | 9.20 | 10.5 | 75 | 9.4–8.4 | Comparison |
| Em-7 | 1.38 | 5.6 | 6.0 | 2.0 | 0.0 | 75 | 9.20 | 3.6 | 75 | 9.4–8.4 | Invention |

*Em-1, 2 and 3: Dissolution of the periphery of host grains hardly occurred.
*Em-6: Only the vertex part of the host grain was dissolved.
*Em-4, 7, and 7: Formation of dislocation lines as shown in FIG. 2 was confirmed.

Preparation of Coated Sample and Development

On a triacetate film support having an undercoat layer, the above-prepared chemically sensitized emulsions Em-1 to Em-7 were coated with a protective layer according to the coating conditions shown in Table 2 below and Sample Nos. 101 to 107 were prepared.

TABLE 2

(1) Emulsion Layer

- Emulsion Em-1 to Em-7 — Ag 1.2 g/m$^2$
- Coupler (compound shown below) — 1.5 × 10$^{-3}$ mol/m$^2$

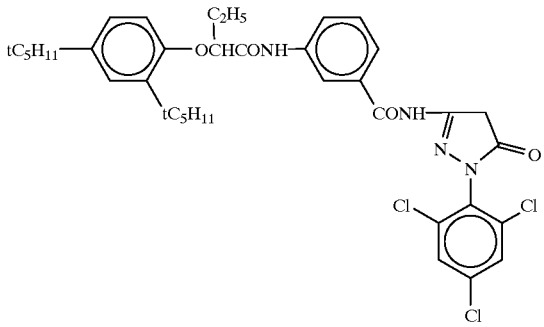

- Tricresyl phosphate — 1.10 g/m$^2$
- Gelatin — 2.30 g/m$^2$ (2) Protective Layer

- Sodium 2,4-Dichloro-6-hydroxy-s-triazine — 0.08 g/m$^2$
- Gelatin — 1.80 g/m$^2$
- Antifoggant (compound shown below) — 8.4 × 10$^{-5}$ mol/m$^2$

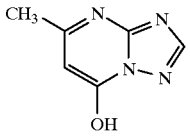

These samples were allowed to stand at 40° C., 70% RH for 14 hours. Then, each sample was exposed for 1/100 sec. through gelatin filter SC-50, a product of Fuji Photo Film Co., Ltd., and continuous wedge.

Samples were processed according to the following step using Nega Processor FP-350 manufactured by Fuji Photo Film Co., Ltd. until the accumulated replenishment amount of the processing solution reached 3 time of the capacity of the mother liquid tank.

| Processing Step: Step | Processing Time | Processing Temperature (° C.) | Replenishment* Amount (ml) |
|---|---|---|---|
| Color Development | 2 min 45 sec | 38 | 45 |
| Bleaching | 1 min 00 sec | 38 | 20 The overflow from the bleaching tank was all introduced into the bleach-fixing tank. |
| Bleach-Fixing | 3 min 15 sec | 38 | 30 |
| Washing (1) | 40 sec | 35 | countercurrent system from (2) to (1) |
| Washing (2) | 1 min 00 sec | 35 | 30 |
| Stabilization | 40 sec | 38 | 20 |
| Drying Step | 1 min 15 sec | 55 | |

*Replenishment rate: per 1.1 meter of a 35 mm wide photographic material (corresponding to a 24 ex. film)

The composition of each processing solution is described below.

| Color Developing Solution | Tank Solution (g) | Replenisher (g) |
|---|---|---|
| Diethylenetriaminepentaacetic Acid | 1.0 | 1.1 |
| 1-Hydroxyethylidene-1,1-diphosphonic Acid | 2.0 | 2.0 |
| Sodium Sulfite | 4.0 | 4.4 |
| Potassium Carbonate | 30.0 | 37.0 |
| Potassiuin Bromide | 1.4 | 0.7 |
| Potassium Iodide | 1.5 mg | — |
| Hydroxylamine Sulfate | 2.4 | 2.8 |

-continued

| | | |
|---|---|---|
| 4-[N-Ethyl-N-(β-hydroxyethyl)-amino]-2-methylaniline Sulfate | 4.5 | 5.5 |
| Water to make | 1.0 l | 1.0 l |
| pH (adjusted with potassium hydroxide and sulfuric acid) | 10.05 | 10.10 |

| Bleaching Solution | Replenisher and tank solution (unit: g) |
|---|---|
| Ammonium Ethylenediaminetetraacetato Ferrate Dihydrate | 120.0 |
| Disodium Ethylenediaminetetraacetate | 10.0 |
| Ammonium Bromide | 100.0 |
| Ammonium Nitrate | 10.0 |
| Bleach Accelerator $(CH_3)_2N—CH_2—CH_2—S—S—CH_2—CH_2—N(CH_3)_2.2HCl$ | 0.005 mol |
| Aqueous Ammonia (27%) | 15.0 ml |
| Water to make | 1.0 l |
| pH (adjusted with aqueous ammonia and nitric acid) | 6.3 |

| Bleach-Fixing Solution | Tank Solution (g) | Replenisher (g) |
|---|---|---|
| Ammonium Ethylenediaminetetra-acetato Ferrate Dihydrate | 50.0 | — |
| Disodium Ethylenediaminetetra-acetate | 5.0 | 2.0 |
| Sodium Sulfite | 12.0 | 20.0 |
| Aqueous Solution of Ammonium Thiosulfate (700 g/liter) | 240.0 ml | 400.0 ml |
| Aqueous Ammonia (27%) | 6.0 ml | — |
| Water to make | 1.0 l | 1.0 l |
| pH (adjusted with aqueous ammonia and acetic acid) | 7.2 | 7.3 |

Washing Water (replenisher and tank solution)

City water was passed through a mixed bed column packed with an H-type strongly acidic cation exchange resin (Amberlite IR-120B of Rohm & Haas) and an OH-type anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 0.15 g/liter of sodium sulfate were added thereto. The pH of this washing water was in the range of from 6.5 to 7.5.

| Stabilizing Solution (replenisher and tank solution) | (unit: g) |
|---|---|
| Sodium p-Toluenesulfinate | 0.03 |
| Polyoxyethylene-p-monononylphenyl Ether (average polymerization degree: | 0.2 |
| Disodium Ethylenediaminetetraacetate | 0.05 |
| 1,2,4-Triazole | 1.3 |
| 1,4-Bis(1,2,4-triazol-1-ylmethyl)-piperazine | 0.75 |
| Water to make | 1.0 l |
| pH | 8.5 |

Density of each processed sample was measured using a green filter. Sensitivity is represented by relative value of the reciprocal of an exposure amount giving the density of fog density +0.2.

For the evaluation of pressureability of each coated sample, the following three kinds of test were conducted.

(1) Pressure resistance by folding

Sample was humidity conditioned at 25° C., 55%, folded with a tester at an angle of 156° with the emulsion face being inside and subjected to exposure and development processing described above. The fog generated at the folded part of the obtained sample was measured with a microdensitometer.

(2) Pressure resistance by scratching with a fine needle

Sample was humidity conditioned at 25° C., 55%, and after the emulsion face of the sample was scratched in a certain direction with a fine needle of a diameter of 50 μm loaded by 4 g, the sample was subjected to exposure and development processing described above. Density reduction of the scratched part of each sample was measured.

(3) Pressure resistance by scratching with a fine needle in a swollen state

After each sample subjected to exposure in the same manner as above was immersed in hot water maintained at 35° C. for 30 sec., the emulsion face of the sample was scratched in a certain direction with a fine needle of a diameter of 50 μm loaded by 4 g, and subjected to development process. The fog generated at the scratched part of each sample was measured with a micro-densitometer.

Sensitivity of each coated sample shown in Table 3 and the results of the above pressure resistance test of each coated sample are shown in Table 3.

TABLE 3

| Sample Sample No. | Emulsion No. | Relative Sensitivity | ΔFog due to Folding (fog after application of pressure) − (fog before application of pressure) | ΔPressure Fog in a Swollen State (fog after application of pressure) − (fog before application of pressure) | Pressure Desensitization due to Fine Needle (Dmax after pressure application) − (Dmax before pressure application) |
|---|---|---|---|---|---|
| 101 (Comparison) | Em-1 | 100 | +0.20 | +0.30 | −0.10 |
| 102 (Comparison) | Em-2 | 90 | +0.30 | +0.80 | −1.50 |
| 103 (Invention) | Em-3 | 110 | +0.50 | +0.50 | −1.00 |
| 104 (Invention) | Em-4 | 135 | +0.20 | +0.40 | −0.05 |
| 105 (Invention) | Em-5 | 158 | +0.15 | +0.15 | −0.05 |
| 106 (Comparison) | Em-6 | 115 | +0.30 | +0.30 | −1.10 |
| 107 (Invention) | Em-7 | 185 | +0.10 | +0.10 | −0.05 |

As is apparent from Table 3, emulsion Em-4 of the present invention is higher in aspect ratio and sensitivity than comparative emulsions Em-1 and Em-2, and reduction of image density due to scratching by a fine needle is extremely small compared with Em-3 which is rapid in supplying speed of iodide ion at the time of dissolution. From these results, it is apparent that sample of the present invention is high sensitive and has remarkable pressure resistance at the same time.

Further, when compared with comparative emulsion Em-4, Em-5 of the present invention can provide still higher sensitivity and low fog by folding, less image density reduction by scratching with a fine needle, and can prevent increase of fog due to scratching in a swollen state by means of increasing the temperature and pAg in the reaction system in a thin layer forming process.

Further, when compared with comparative emulsion Em-5, Em-7 of the present invention can provide an emulsion which is high sensitive and, at the same time, which has high resistance against various pressures by means of regulating iodide composition and providing pure silver iodide layer as the outermost layer. It is apparent from emulsions Em-3 and Em-5 that the relationship between the iodide content of host grains and the amount of iodide to be added in a dissolution process is very important.

EXAMPLE 2

Multilayer color photographic material Sample No. 201 was prepared using the emulsion according to the present invention described in Example 1 in the photographic material shown below. Sample Nos. 202 to 207 were prepared by replacing Em-1 in the tenth layer with Em-2 to Em-7, respectively.

1) Support

The support used in this example was prepared according to the following manner.

100 weight parts of polyethylene-2,6-naphthalate polymer and 2 weight parts of Tinuvin P. 326 (product of Ciba Geigy AG), as an ultraviolet absorbing agent, were dried, then melted at 300° C., subsequently, extruded through a T-type die, and stretched 3.3 times in a machine direction at 140° C. and then 3.3 times in a transverse direction at 130° C., and further thermally fixed for 6 seconds at 250° C. and the PEN film having the thickness of 90 μm was obtained. Appropriate amounts of blue dyes, magenta dyes and yellow dyes were added to the PEN film (I-1, I-4, I-6, I-24, I-26, I-27 and II-5 disclosed in Journal of Technical Disclosure (Kokai-Giho), No. 94-6023). Further, the film was wound on to a stainless steel spool having a diameter of 20 cm and provided heat history at 110° C. for 48 hours to obtain a support reluctant to get curling habit.

2) Coating of undercoat layer

After both surfaces of the above support were subjected to corona discharge, UV discharge and glow discharge treatments, on each side of the support an undercoat solution having the following composition was coated (10 ml/m$^2$, using a bar coater): 0.1 g/m$^2$ of gelatin, 0.01 g/m$^2$ of sodium a-sulfo-di-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of polyamide-epichlorohydrin polycondensation product. The undercoat layer was provided on the hotter side at the time of stretching. Drying was conducted at 115° C. for 6 minutes (the temperature of the roller and transporting device of the drying zone was 115° C.).

3) Coating of backing layer

On one side of the above support after undercoat layer coating, an antistatic layer, a magnetic recording layer and a libricating layer having the following compositions were coated as backing layers.

3-1) Coating of antistatic layer 0.2 g/m$^2$ of a dispersion of fine grain powder of a stannic oxide-antimony oxide composite having the average grain size of 0.005 μm and specific resistance of 5 Ω.cm (the grain size of the second agglomerate: about 0.08 μm), 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree: 10) and resorcin were coated.

3-2) Coating of magnetic recording layer 0.06 g/m$^2$ of cobalt-γ-iron oxide which was coating-treated with 3-polyoxyethylene-propyloxytrimethoxysilane (polymerization degree: 15) (15 wt %) (specific surface area: 43 m$^2$/g, major axis: 0.14 μm, minor axis: 0.03 μm, saturation magnetization: 89 emu/g, $Fe^{+2}/Fe^{+3}$ is 6/94, the surface was treated with 2 wt %, respectively, based on the iron oxide, of aluminum oxide and silicon oxide), 1.2 g/m$^2$ of diacetyl cellulose (dispersion of the iron oxide was carried out using an open kneader and a sand mill), 0.3 g/m$^2$ of $C_2H_5C[CH_2OCONH\text{-}C_6H_3(CH_3)NCO]_3$ as a curing agent, with acetone, methyl ethyl ketone and cyclohexanone as solvents, were coated with a bar coater to obtain a magnetic recording layer having the film thickness of 1.2 μm. As matting agents, silica grains (0.3 μm) and an aluminum oxide abrasive (0.15 μm) coating-treated with 3-polyoxyethylene-propyloxytrimethoxysilane (polymerization degree: 15) (15 wt %) were added each in an amount of 10 mg/m$^2$. Drying was conducted at 115° C. for 6 minutes (the temperature of the roller and transporting device of the drying zone was 115° C.). The increase of the color density of $D^B$ of the magnetic recording layer by X-light (a blue filter) was about 0.1, and saturation magnetization moment of the magnetic recording layer was 4.2 emu/g, coercive force was $7.3\times10^4$ A/m, and rectangular ratio was 65%.

3-3) Preparation of lubricating layer

Diacetyl cellulose (25 mg/m$^2$), and a mixture of $C_6H_{13}CH(OH)C_{10}H_{20}COOC_{40}H_{81}$ (Compound a, 6 mg/m$^2$)/$C_{50}H_{101}O(CH_2CH_2O)_{16}H$ (Compound b, 91 mg/m$^2$) were coated. This mixture of Compound a/Compound b was dissolved in xylene/propylene monomethyl ether (1/1) by heating at 105° C., and poured into propylene monomethyl ether (10 time amount) at room temperature and dispersed, and further dispersed in acetone (average grain size: 0.01 μm), then added to the coating solution. Silica grains (0.3 μm), as a matting agent, and aluminum oxide (0.15 μm) coated with 3-polyoxyethylene-propyloxytrimethoxysilane (polymerization degree: 15) (15 wt %), as an abrasive were added each in an amount of 15 mg/m$^2$. Drying was conducted at 115° C. for 6 minutes (the temperature of the roller and transporting device of the drying zone was 115° C.). The thus-obtained lubricating layer showed excellent characteristic of dynamic friction coefficient of 0.06 (a stainless steel hard ball, diameter: 5 mm, load: 100 g, speed: 6 cm/min), static friction coefficient of 0.07 (a clip method), and the lubricating property with the surface of the emulsion described below provided dynamic friction coefficient of 0.12.

4) Coating of light-sensitive laver

Next, each layer having the following composition was multilayer coated on the opposite side of the above obtained backing layer and a color negative film was prepared as Sample No. 201.

Composition of Light-Sensitive Layer

The main components for use in each layer are classified as follows:

ExC: Cyan Coupler
ExM: Magenta Coupler
ExY: Yellow Coupler
ExS: Sensitizing Dye
UV: Ultraviolet Absorber
HBS: High Boiling Point Organic Solvent
H: Hardening Agent for Gelatin The numeral corresponding to each component indicates the coated weight in unit of g/m$^2$, and the coated weight of silver halide is shown as the calculated weight of silver. Further, in the case of a sensitizing dye, the coated weight is indicated in unit of mol per mol of silver halide in the same layer.

| | |
|---|---|
| First Layer: Antihalation Layer | |
| Black Colloidal Silver | 0.09 as silver |
| Gelatin | 0.70 |
| Second Layer: Antihalation Layer | |
| Black Colloidal Silver | 0.09 as silver |
| Gelatin | 1.00 |
| ExM-1 | 0.12 |
| ExF-1 | $2.0 \times 10^{-3}$ |
| Solid Dispersion Dye ExF-2 | 0.030 |
| Solid Dispersion Dye ExF-3 | 0.040 |
| HBS-1 | 0.15 |
| HBS-2 | 0.02 |
| Third Layer: Interlayer | |
| ExC-2 | 0.05 |
| Polyethyl Acrylate Latex | 0.20 |
| Gelatin | 0.70 |
| Fourth Layer: Low Sensitivity Red-Sensitive Emulsion Layer | |
| Silver Iodobromide Emulsion A | 0.20 as silver |
| Silver Iodobromide Emuision B | 0.23 as silver |
| Silver Iodobromide Emulsion C | 0.10 as silver |
| ExS-1 | $3.8 \times 10^{-4}$ |
| ExS-2 | $1.6 \times 10^{-5}$ |
| ExS-3 | $5.2 \times 10^{-4}$ |
| ExC-1 | 0.17 |
| ExC-2 | 0.02 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 1.10 |
| Fifth Layer: Middle Sensitivity Red-Sensitive Emulsion Layer | |
| Silver Iodobromide Emulsion C | 0.15 as silver |
| Silver Iodobromide Emulsion D | 0.46 as silver |
| ExS-1 | $4.0 \times 10^{-4}$ |
| ExS-2 | $2.1 \times 10^{-5}$ |
| ExS-3 | $5.7 \times 10^{-4}$ |
| ExC-1 | 0.14 |
| ExC-2 | 0.02 |
| ExC-3 | 0.03 |
| ExC-4 | 0.090 |
| ExC-5 | 0.02 |
| ExC-6 | 0.01 |
| Cpd-4 | 0.030 |
| Cpd-2 | 0.05 |
| HBS-1 | 0.10 |
| Gelatin | 0.75 |
| Sixth Layer: High Sensitivity Red-Sensitive Emulsion Layer | |
| Silver Iodobromide Emulsion E | 1.30 as silver |
| ExS-1 | $2.5 \times 10^{-4}$ |
| ExS-2 | $1.1 \times 10^{-5}$ |
| ExS-3 | $3.6 \times 10^{-4}$ |
| ExC-1 | 0.12 |
| ExC-3 | 0.11 |
| ExC-6 | 0.020 |
| ExC-7 | 0.010 |
| Cpd-2 | 0.050 |
| Cpd-4 | 0.020 |
| HBS-1 | 0.22 |
| HBS-2 | 0.050 |
| Gelatin | 1.40 |
| Seventh Layer: Interlayer | |
| Cpd-1 | 0.060 |

-continued

| | |
|---|---|
| Solid Dispersion Dye ExF-4 | 0.030 |
| HBS-1 | 0.040 |
| Polyethyl Acrylate Latex | 0.15 |
| Gelatin | 1.10 |
| Eighth Layer: Low Sensitivity Green-Sensitive Emulsion Layer | |
| Silver Iodobromide Emulsion F | 0.22 as silver |
| Siiver Iodobromide Emulsion G | 0.35 as silver |
| ExS-7 | $6.2 \times 10^{-4}$ |
| ExS-8 | $1.4 \times 10^{-4}$ |
| ExS-4 | $2.7 \times 10^{-5}$ |
| ExS-5 | $7.0 \times 10^{-5}$ |
| ExS-6 | $2.7 \times 10^{-4}$ |
| ExM-3 | 0.410 |
| ExM-4 | 0.086 |
| ExY-1 | 0.070 |
| ExY-5 | 0.0070 |
| HBS-1 | 0.30 |
| HBS-3 | 0.015 |
| Cpd-4 | 0.010 |
| Gelatin | 0.95 |
| Ninth Layer: Middle Sensitivity Green-Sensitive Emulsion Layer | |
| Silver Iodobromide Emulsion G | 0.48 as silver |
| Silver Iodobromide Emulsion H | 0.48 as silver |
| ExS-4 | $4.8 \times 10^{-5}$ |
| ExS-7 | $9.3 \times 10^{-4}$ |
| ExS-8 | $2.1 \times 10^{-5}$ |
| ExC-8 | 0.0020 |
| ExM-3 | 0.115 |
| ExM-4 | 0.035 |
| ExY-1 | 0.010 |
| ExY-4 | 0.010 |
| ExY-5 | 0.0050 |
| Cpd-4 | 0.011 |
| HBS-1 | 0.13 |
| HBS-3 | $4.4 \times 10^{-3}$ |
| Gelatin | 0.80 |
| Tenth Layer: High Sensitivity Green-Sensitive Emulsion Layer | |
| Emulsion Em-1 | 1.30 as silver |
| ExS-4 | $4.5 \times 10^{-5}$ |
| ExS-7 | $5.3 \times 10^{-4}$ |
| ExS-8 | $1.2 \times 10^{-4}$ |
| ExC-1 | 0.021 |
| ExM-1 | 0.010 |
| ExM-2 | 0.030 |
| ExM-5 | 0.0070 |
| ExM-6 | 0.0050 |
| Cpd-3 | 0.017 |
| Cpd-4 | 0.040 |
| HBS-1 | 0.25 |
| Polyethyl Acrylate Latex | 0.15 |
| Gelatin | 1.33 |
| Eleventh Layer: Yellow Filter Layer | |
| Yellow Colloidal Silver | 0.015 as silver |
| Cpd-1 | 0.16 |
| Solid Dispersion Dye ExF-5 | 0.060 |
| Solid Dispersion Dye ExF-6 | 0.060 |
| Oil-Soluble Dye ExF-7 | 0.010 |

-continued

| | |
|---|---|
| HBS-1 | 0.60 |
| Gelatin | 0.60 |
| Twelfth Layer: Low Sensitivity Blue-Sensitive Emulsion Layer | |
| Silver Iodobromide Emulsion I | 0.09 as silver |
| Silver Iodobromide Emulsion J | 0.10 as siiver |
| Silver Iodobromide Emulsion K | 0.25 as silver |
| ExS-9 | $8.4 \times 10^{-4}$ |
| ExC-1 | 0.03 |
| ExC-8 | $7.0 \times 10^{-3}$ |
| ExY-1 | 0.050 |
| ExY-2 | 0.75 |
| ExY-3 | 0.40 |
| ExY-4 | 0.040 |
| Cpd-2 | 0.10 |
| Cpd-4 | 0.01 |
| Cpd-3 | $4.0 \times 10^{-3}$ |
| HBS-1 | 0.28 |
| Gelatin | 2.10 |
| Thirteenth Layer: High Sensitivity Blue-Sensitive Emulsion Layer | |
| Silver Iodobromide Emulsion L | 0.58 as silver |
| ExS-9 | $3.5 \times 10^{-4}$ |
| ExY-2 | 0.070 |
| ExY-3 | 0.070 |
| ExY-4 | 0.0050 |
| Cpd-2 | 0.10 |
| Cpd-3 | $1.0 \times 10^{-3}$ |
| Cpd-4 | 0.02 |
| HBS-1 | 0.075 |
| Gelatin | 0.55 |
| Fourteenth Layer: First Protective Layer | |
| Silver Iodobromide Emulsion M | 0.10 as silver |
| UV-1 | 0.13 |
| UV-2 | 0.10 |
| UV-3 | 0.16 |
| UV-4 | 0.025 |
| ExF-8 | 0.001 |
| ExF-9 | 0.002 |
| HBS-1 | $5.0 \times 10^{-2}$ |
| HBS-4 | $5.0 \times 10^{-2}$ |
| Gelatin | 1.8 |
| Fifteenth Layer: Second Protective Layer | |
| H-1 | 0.40 |
| B-1 (diameter: 1.7 $\mu$m) | 0.06 |
| B-2 (diameter: 1.7 $\mu$m) | 0.09 |
| B-3 | 0.13 |
| ES-1 | 0.20 |
| Gelatin | 0.70 |

Further, W-1 to W-3, B-4 to B-6, F-1 to F-18, iron salt, lead salt, gold salt, platinum salt, palladium salt, iridium salt and rhodium salt were appropriately included in each layer to improve storage stability, processing properties, pressure resistance, fungicidal and biocidal properties, antistatic properties and coating properties.

TABLE 4

| Emulsion | Average AgI Content (%) | Average Diameter Corresponding to Sphere (μm) | Variation Coefficient of the Grain Size (%) | Projected Area Diameter Corresponding to Circle (μm) | Diameter/ Thickness Ratio | Tabularity |
|---|---|---|---|---|---|---|
| A | 3.7 | 0.37 | 13 | 0.43 | 2.3 | 12 |
| B | 3.7 | 0.43 | 19 | 0.58 | 3.2 | 18 |
| C | 5.0 | 0.55 | 20 | 0.86 | 6.2 | 45 |
| D | 5.4 | 0.66 | 23 | 1.10 | 7.0 | 45 |
| E | 4.7 | 0.85 | 22 | 1.36 | 5.5 | 22 |
| F | 3.7 | 0.43 | 19 | 0.58 | 3.2 | 18 |
| G | 5.4 | 0.55 | 20 | 0.86 | 6.2 | 45 |
| H | 5.4 | 0.66 | 23 | 1.10 | 7.0 | 45 |
| I | 3.7 | 0.37 | 19 | 0.55 | 4.6 | 38 |
| J | 3.7 | 0.37 | 19 | 0.55 | 4.6 | 38 |
| K | 8.8 | 0.64 | 23 | 0.85 | 5.2 | 32 |
| L | 6.3 | 1.05 | 20 | 1.46 | 3.7 | 9 |
| M | 1.0 | 0.07 | — | — | 1.0 | — |

In Table 4:

(1) Emulsions I to L were reduction sensitized during preparation of the grains using thiourea dioxide and thiosulfonic acid according to the examples of JP-A2-191938.

(2) Emulsions C to E, G and H were gold, sulfur, and selenium sensitized, respectively, in the presence of the spectral sensitizing dyes which are described at each light-sensitive layer and sodium thiocyanate according to the examples of JP-A-3-237450.

(3) Low molecular weight gelatin was used in the preparation of the tabular grains according to the examples of JP-A-1-158426.

(4) In tabular grains, there were observed such dislocation lines as disclosed in JP-A-3-237450, using a high voltage electron microscope.

(5) Emulsions A to E, G, H, I to L contain optimal amount of Rh, Ir and Fe. Tabularity means the value defined by the equation $D_c/t^2$, taking the diameter corresponding to circle of the projected area of the tabular grain as $D_c$ and the average thickness of the tabular grain as t.

Preparation of Dispersion of Organic Solid Dispersion Dye

ExF-2 shown below was dispersed according to the following method. That is, 21.7 ml of water, 3 ml of a 5% aqueous solution of sodium p-octylphenoxyethoxyethoxyethanesulfonate, and 0.5 g of a 5% aqueous solution of p-octyl-phenoxypolyoxyethylene ether (polymerization degree: 10) were put in a pot mill having a capacity of 700 ml, and 5.0 g of Dye ExF-2 and 500 ml of zirconium oxide beads (diameter: 1 mm) were added thereto and the content was dispersed for 2 hours. The vibrating ball mill which was used was BO type ball mill manufactured by Chuo Koki. The content was taken out after dispersion and added to 8 g of a 12.5% aqueous solution of gelatin and the beads were removed by filtration and the gelatin dispersion of the dye was obtained. The average grain size of fine grains of the dye was 0.44 μm.

Solid dispersions of ExF-3, ExF-4 and ExF-6 were obtained in the same manner. The average grain sizes of fine grains of the dyes were 0.24 μm, 0.45 μm and 0.52 μm, respectively. ExF-5 was dispersed according to the micro-precipitation dispersion method disclosed in Working Example 1 of EP-A-549489. The average grain size was 0.06 μm.

ExC-1

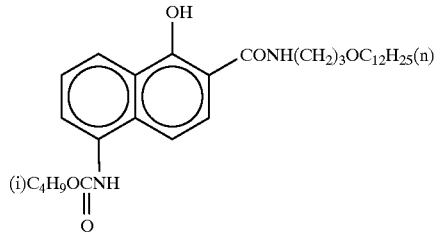

-continued
ExC-2
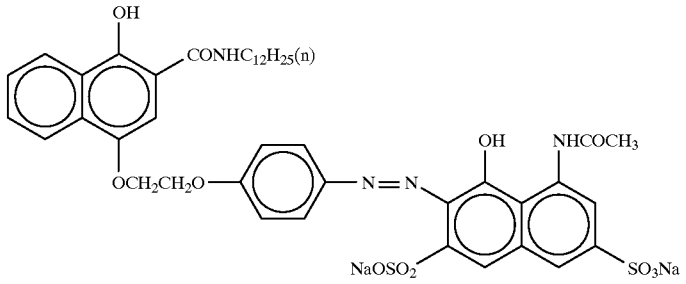
ExC-3
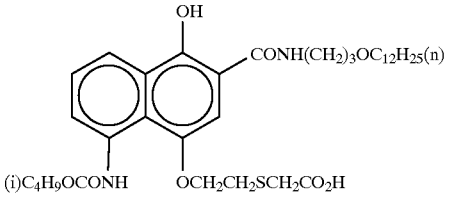
ExC-4
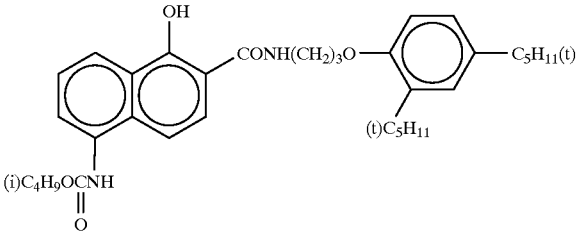
ExC-5
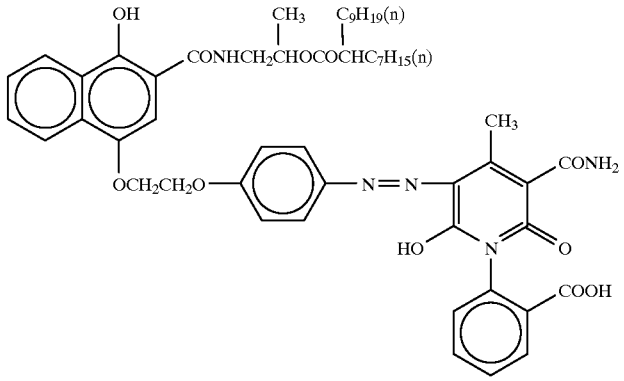

-continued
ExC-6
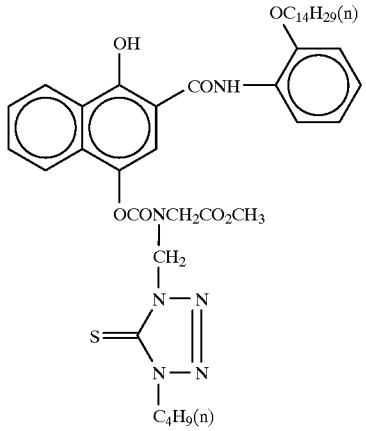
ExC-7
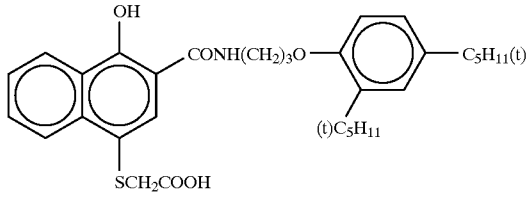
ExC-8
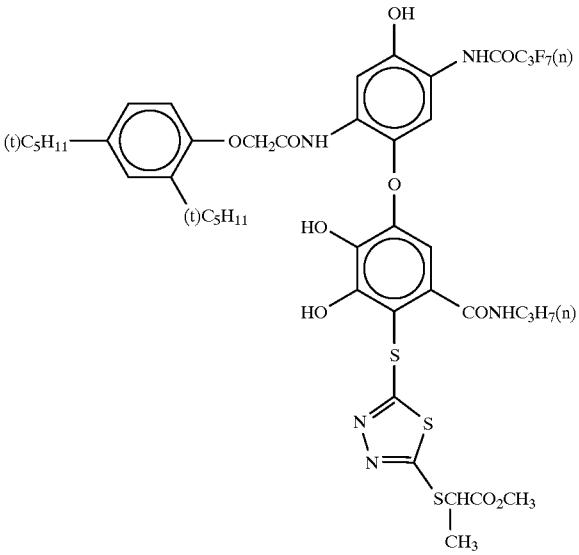

-continued
ExM-1
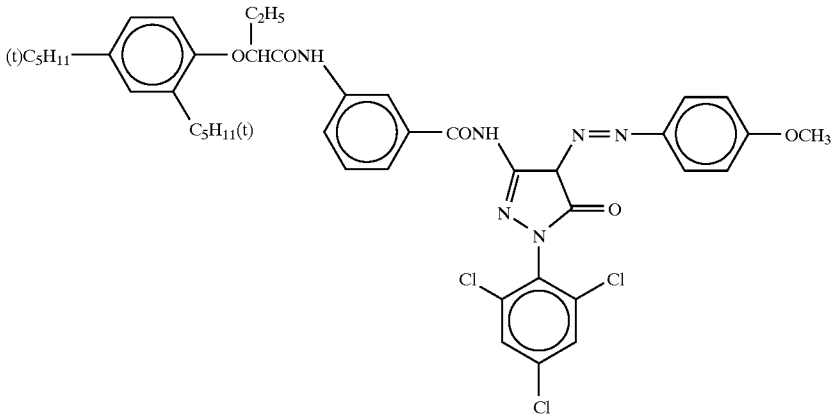
ExM-2
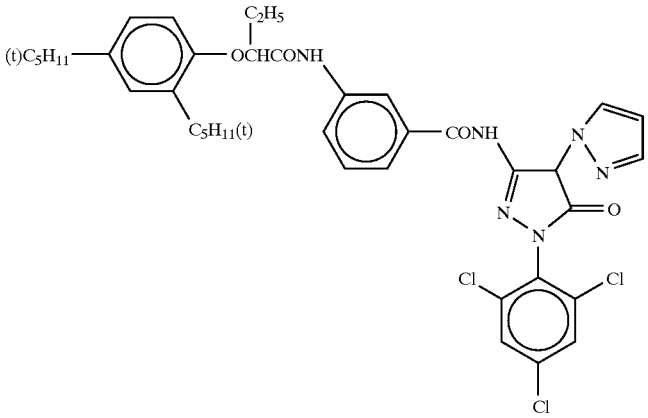
ExM-3
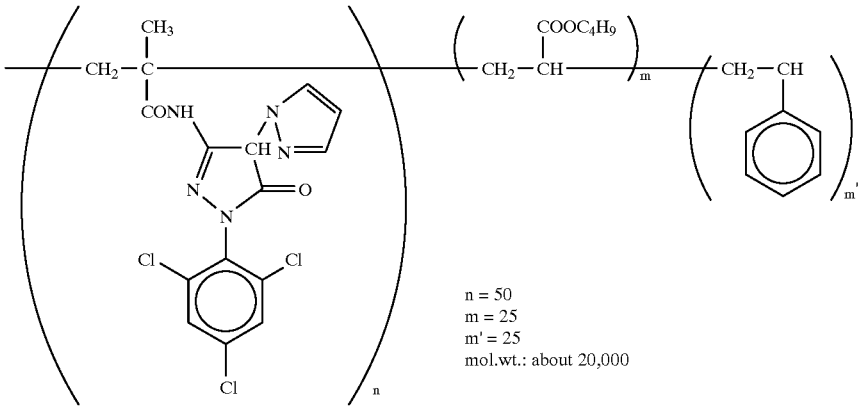
n = 50
m = 25
m' = 25
mol.wt.: about 20,000

-continued
ExM-4
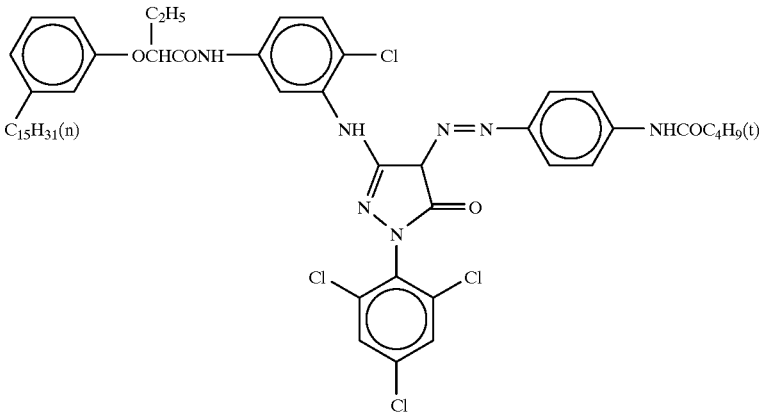
ExM-5
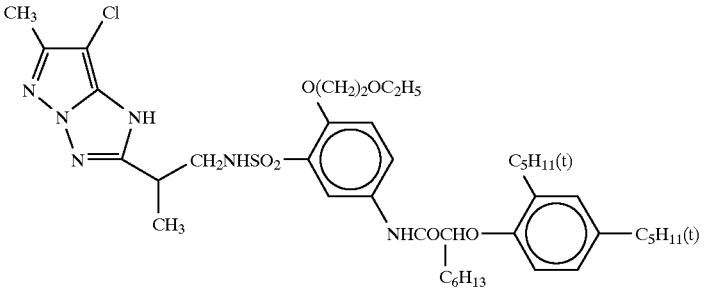
ExM-6
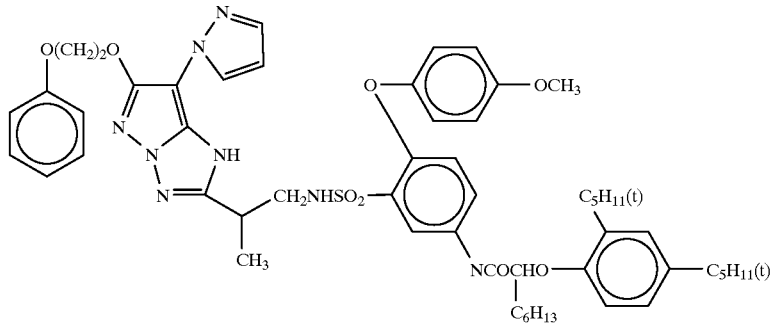
ExY-1
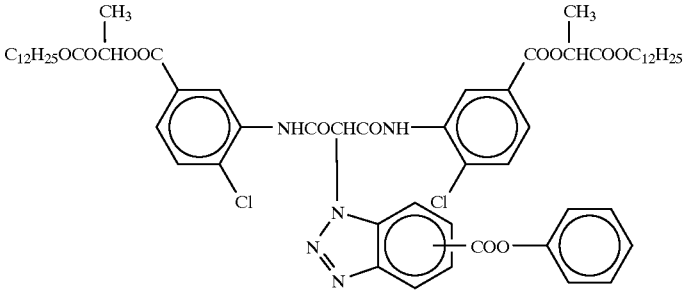

-continued
ExY-2
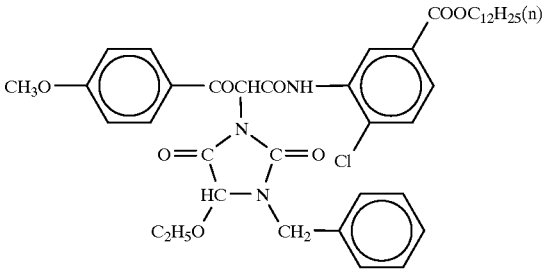
ExY-3
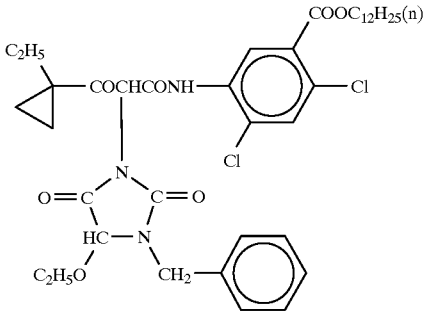
ExY-4
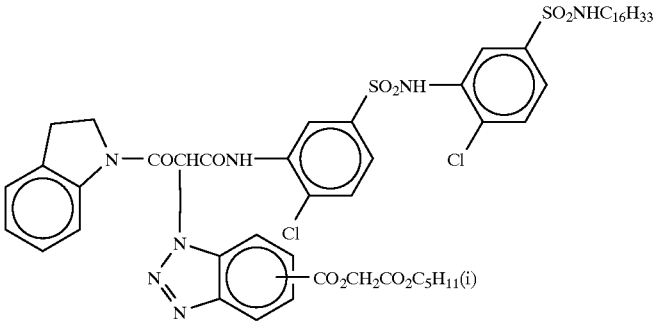
ExY-5
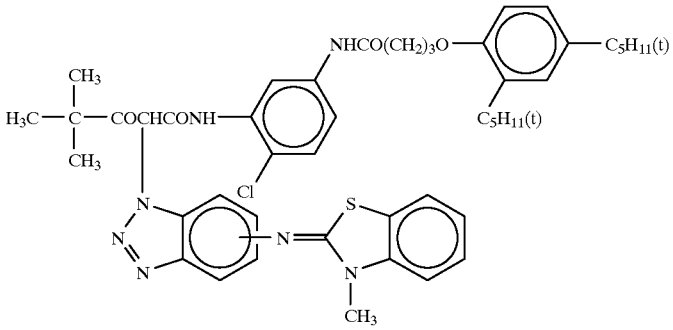
ExF-1
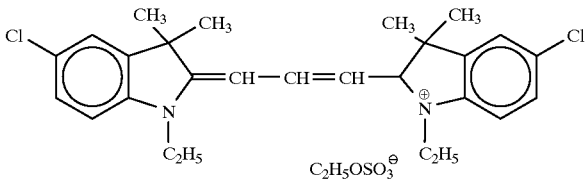

-continued
ExF-2
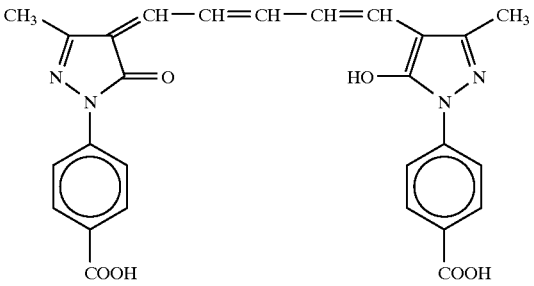
ExF-3
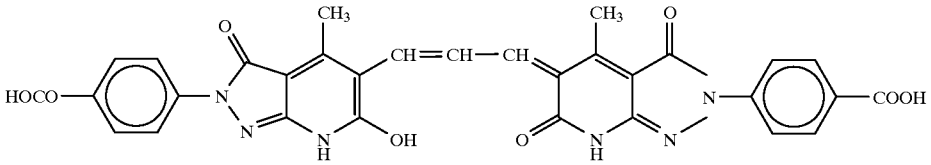
ExF-4
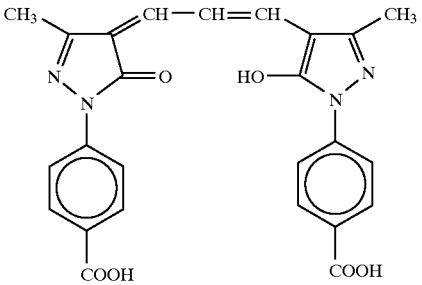
ExF-5
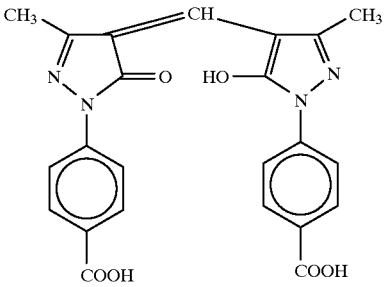
ExF-6
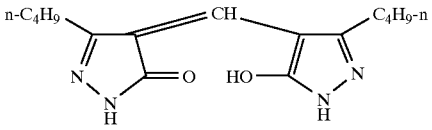
ExF-7
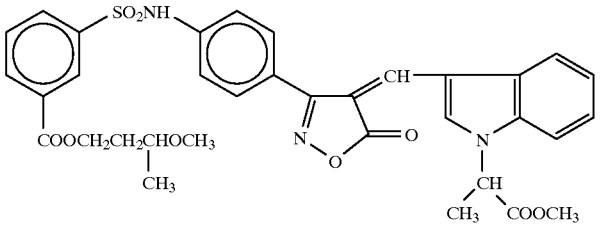

-continued
ExF-8
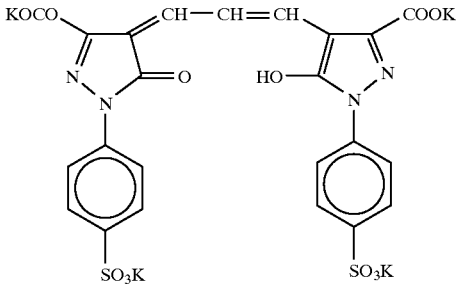
ExF-9
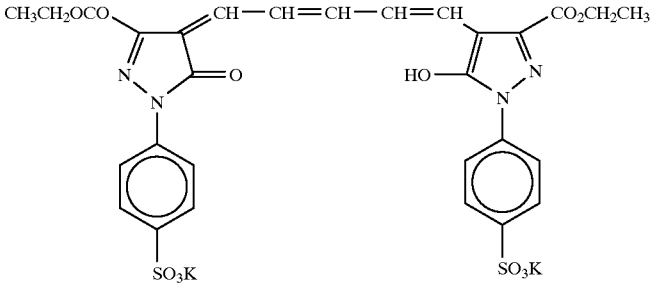
Cpd-1
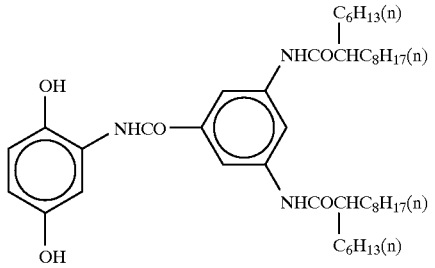
Cpd-2
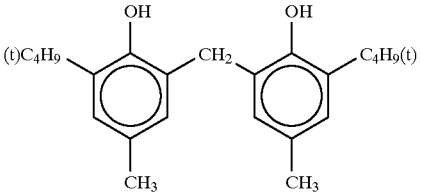
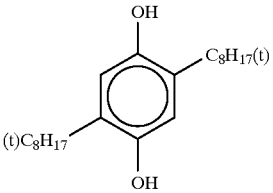
Cpd-3
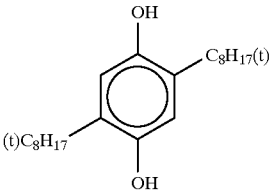

-continued
Cpd-4
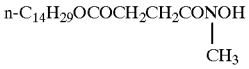
UV-2
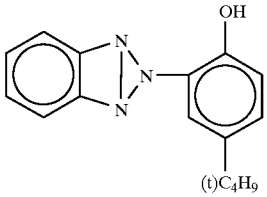
UV-4
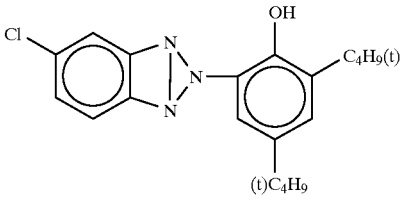
UV-3
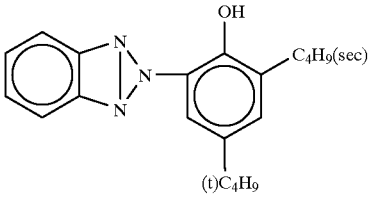
HBS-1
Tricresyl Phosphate
HBS-2
Di-n-butyl Phthalate
HBS-3
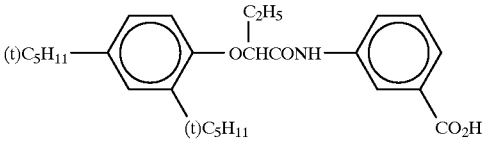
HBS-4
Tri(2-ethylhexyl) Phosphate
ExS-1
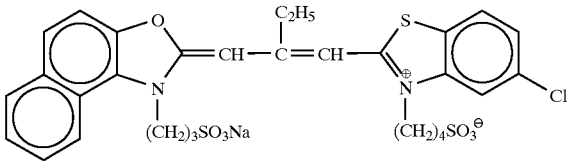
ExS-2
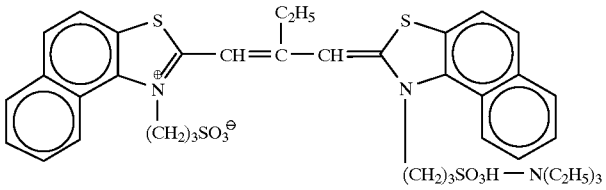

-continued
ExS-3
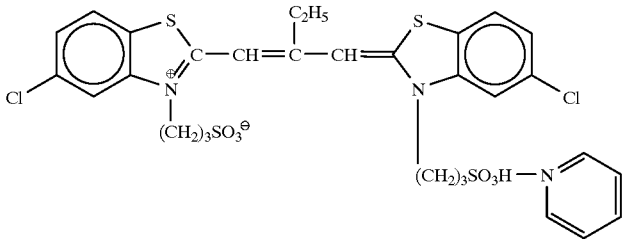
ExS-4
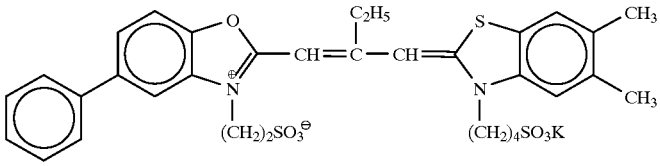
ExS-5
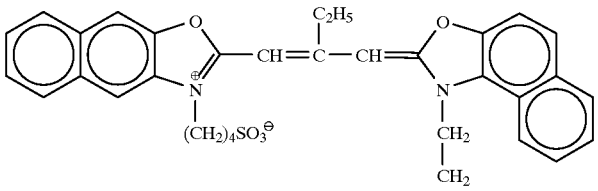
ExS-6
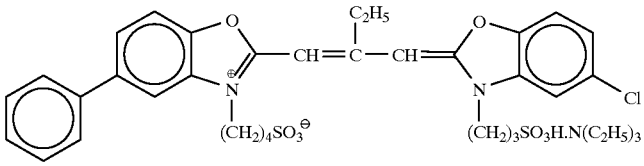
ExS-8
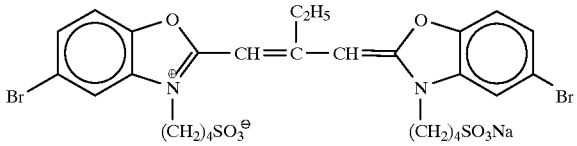
ExS-9
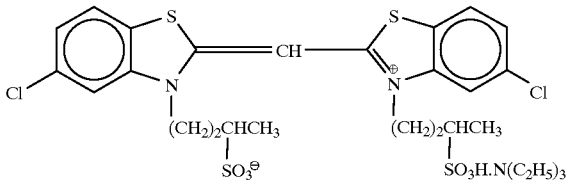
ES-1
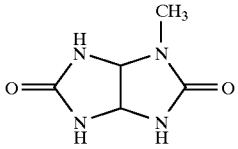
H-1
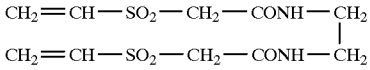

-continued
B-1
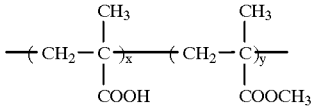
x/y = 10/90
average molecular weight:
about 35,000
B-2
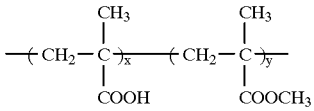
x/y = 40/60
average molecular weight:
about 20,000
B-3
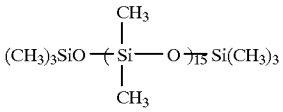
B-4
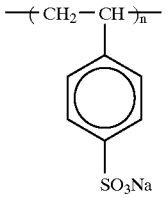
(mol ratio)
average molecular weight:
about 750,000
B-5
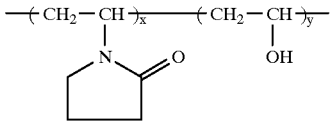
x/y = 70/30
average molecular weight:
about 17,000
B-6
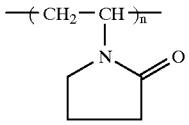
average molecular weight:
about 10,000
W-1
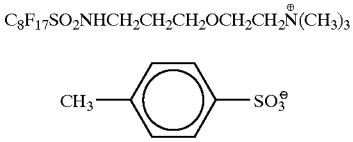
W-2
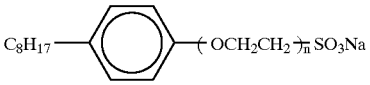
n = 2 ~ 4
W-3
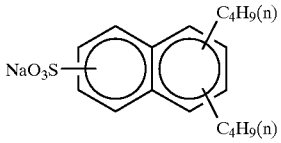
F-1
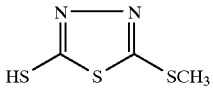

-continued
F-2
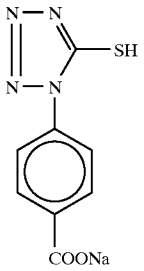
F-3
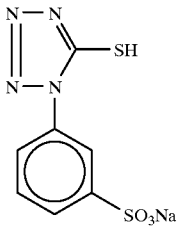
F-4
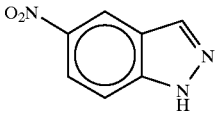
F-5
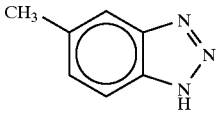
F-6
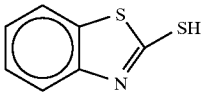
F-7
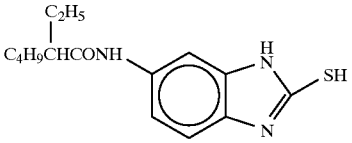
F-8
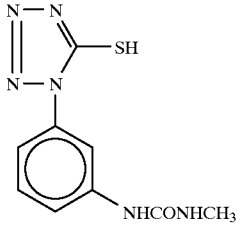
F-9
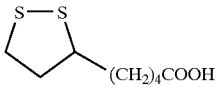

-continued

F-10

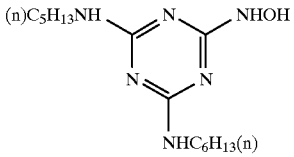

F-11

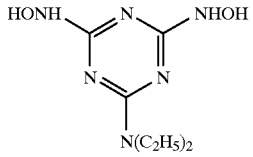

F-12

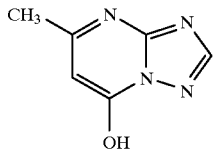

F-13

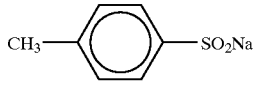

F-14

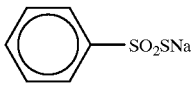

F-15

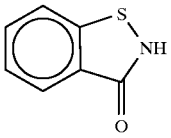

F-16

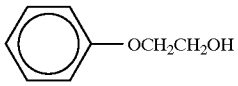

F-17

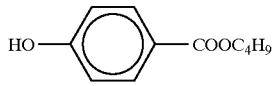

F-18

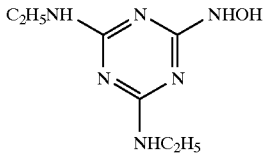

The thus prepared photographic material was cut to a size of 24 mm in width and 160 cm in length, and two perforations of 2 mm square at an interval of 5.8 mm were provided 0.7 mm inside from one side width direction in the length direction of the photographic material. The sample provided with this set of two perforations at intervals of 32 mm was prepared and encased in the plastic film cartridge explained in FIG. 1 to FIG. 7 in U.S. Pat. No. 5,296,887.

FM signals were recorded between the above perforations of the sample from the side of the magnetic recording layer coated on the support using a head capable of in and out of 2,000 turns with head gap of 5 $\mu$m at a feed rate of 100 mm/s.

After FM signals were recorded, the emulsion surface was subjected to entire and uniform exposure of 1,000 cms and each process was conducted according to the following method, and each sample was put in the above plastic film cartridge again.

Sample Nos. 201 to 207 cut to a width of 35 mm and photographed with a camera were processed (running process) at a rate of $m^2$ per a day for 15 days as follows.

Each processing was conducted using an automatic processor FP-360B manufactured by Fuji Photo Film Co., Ltd. according to the following step. Further, the processor was modified so that the overflow from the bleaching bath was discharged to the waste solution tank not to flow to the after bath. FP-360B processor carried the evaporation compensating means disclosed in Hatsumei Kyokai Kokai Giho No. 94-4992.

The processing step and the composition of each processing solution are as follows.

Processing Step

| Step | Processing Time | Processing Temperature (° C.) | Replenishment* Amount (ml) |
|---|---|---|---|
| Color Development | 2 min 45 sec | 38 | 45 |
| Bleaching | 1 min 00 sec | 38 | 20 The overflow from the bleaching tank was all introduced into the bleach-fixing tank. |
| Bleach-Fixing | 3 min 15 sec | 38 | 30 |
| Washing (1) | 40 sec | 35 | countercurrent system from (2) to (1) |
| Washing (2) | 1 min 00 sec | 35 | 30 |
| Stabilization | 40 sec | 38 | 20 |
| Drying | 1 min 15 sec | 55 | |

*Replenishinent rate: per 1.1 meter of a 35 mm wide photographic material (corresponding to a 24 ex. film)

The composition of each processing solution is described below.

| Color Developing Solution | Tank Solution (g) | Replenisher (g) |
|---|---|---|
| Diethylenetriaminepentaacetic Acid | 1.0 | 1.1 |
| 1-Hydroxyethylidene-1,1-diphosphonic Acid | 2.0 | 2.0 |
| Sodium Sulfite | 4.0 | 4.4 |
| Potassium Carbonate | 30.0 | 37.0 |
| Potassium Bromide | 1.4 | 0.7 |
| Potassium Iodide | 1.5 mg | — |
| Hydroxylamine Sulfate | 2.4 | 2.8 |
| 4-[N-Ethyl-N-(β-hydroxyethyl)-amino]-2-methylaniline Sulfate | 4.5 | 5.5 |
| Water to make | 1.0 l | 1.0 l |
| pH (adjusted with potassium hydroxide and sulfuric acid) | 10.05 | 10.10 |

| Bleaching Solution | Replenisher and tank solution (unit: g) |
|---|---|
| Ammonium Ethylenediaminetetraacetato Ferrate Dihydrate | 120.0 |
| Disodium Ethylenediaminetetraacetate | 10.0 |
| Ammonium Bromide | 100.0 |
| Ammonium Nitrate | 10.0 |
| Bleach Accelerator $(CH_3)_2N—CH_2—CH_2—S—S—CH_2—CH_2—N(CH_3)_2.2HCl$ | 0.005 mol |
| Aqueous Ammonia (27%) | 15.0 ml |
| Water to make | 1.0 l |
| pH (adjusted with aqueous ammonia and nitric acid) | 6.3 |

| Bleach-Fixing Solution | Tank Solution (g) | Replenisher (g) |
|---|---|---|
| Ammonium Ethylenediaminetetra-acetato Ferrate Dihydrate | 50.0 | — |
| Disodium Ethylenediaminetetra-acetate | 5.0 | 2.0 |
| Sodium Sulfite | 12.0 | 20.0 |
| Aqueous Solution of Ammonium Thiosulfate (700 g/liter) | 240.0 ml | 400.0 ml |
| Aqueous Ammonia (27%) | 6.0 ml | |
| Water to make | 1.0 l | 1.0 l |
| pH (adjusted with aqueous ammonia and acetic acid) | 7.2 | 7.3 |

Washing Water (replenisher and tank solution)

City water was passed through a mixed bed column packed with an H-type strongly acidic cation exchange resin (Amberlite IR-120B of Rohm & Haas) and an OH-type anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 0.15 g/liter of sodium sulfate were added thereto. The pH of this washing water was in the range of from 6.5 to 7.5.

Stabilizing Solution (replenisher and tank solution)

| | (unit: g) |
|---|---|
| Sodium p-Toluenesulfinate | 0.03 |
| Polyoxyethylene-p-monononylphenyl Ether (average polymerization degree: 10) | 0.2 |
| Disodium Ethylenediaminetetraacetate | 0.05 |
| 1,2,4-Triazole | 1.3 |
| 1,4-Bis(1,2,4-triazol-1-ylmethyl)-piperazine | 0.75 |
| Water to make | 1.0 l |
| pH | 8.5 |

After each sample was wedgewise exposed by white light and processed as described above, the density was measured.

The sensitivity of the tenth layer was evaluated from the exposure amount giving the density of minimum density +0.1 of the magenta density. As for the evaluation of pressureability, the above-described three kinds of tests were conducted. The results obtained are shown in Table 5 below.

As is apparent from the results in Table 5, Sample Nos. 204 and 205 using the emulsion of the present invention materialized a multilayer color photographic material having high sensitivity and pressure resistance against various external pressures as well.

TABLE 5

| Sample Sample No. | Emulsion No. | Relative Sensitivity Fog + 0.1 (magenta) | ΔFog due to Folding (fog after application of pressure) − (fog before application of pressure) | ΔPressure Fog in a Swollen State (fog after application of pressure) − (fog before application of pressure) | Pressure Desensitization due to Fine Needle (existence of pressure desensitization in magenta image) |
|---|---|---|---|---|---|
| 201 (Comparison) | Em-1 | 100 | +0.40 | +0.15 | absent |
| 202 (Comparison) | Em-2 | 92 | +0.55 | +0.40 | present |
| 203 (Comparison) | Em-3 | 107 | +1.00 | +0.30 | present |
| 204 (Invention) | Em-4 | 120 | +0.20 | +0.40 | absent |
| 205 (Invention) | Em-5 | 158 | +0.20 | +0.15 | absent |
| 206 (Comparison) | Em-6 | 105 | +0.50 | +0.30 | present |
| 207 (Invention) | Em-7 | 180 | +0.15 | +0.10 | absent |

A silver halide photographic material which is high sensitive and less in fluctuation in photographic properties due to a stress can be obtained using the emulsion produced according to the present invention.

While the invention has been described in detail and with reference to specific examples thereof, it will be apparent to one skilled in the art that various changes and modifications can be made therein without departing from the spirit and scope thereof.

What is claimed is:

1. A method for producing a silver halide photographic emulsion comprising the steps of:

(a) producing a host emulsion comprising silver bromide or silver iodobromide hexagonal or triangular {111} tabular grains having an average silver iodide content ($I_1$ mol %) of the entire silver halide grains of the host emulsion of 5 mol % or less, in which 60% or more of the projected area of said entire silver halide grains accounting for tabular grains having an aspect ratio of 3.0 or more;

(b) dissolving a periphery of said tabular grains completely with an iodide ion being added to said host emulsion; and then (c) producing final tabular grains by reclaiming a periphery containing silver iodobromide from the region containing said periphery having been completely dissolved.

2. The method for producing a silver halide photographic emulsion as claimed in claim 1, wherein 60% or more of the projected area of said entire silver halide grains accounting for tabular grains have an aspect ratio of 5.0 or more.

3. The method for producing a silver halide photographic emulsion as claimed in claim 2, wherein 60% or more of the projected area of said entire silver halide grains accounting for tabular grains have an aspect ratio of 7.0 or more.

4. The method for producing a silver halide photographic emulsion as claimed in claim 3, wherein 60% or more of the projected area of said entire silver halide grains accounting for tabular grains have an aspect ratio of from 7.0 to 20.

5. The method for producing a silver halide photographic emulsion as claimed in claim 1, wherein said host grain has a diameter of from 0.2 to 5.0 μm and a thickness of less than 0.5 μm.

6. The method for producing a silver halide photographic emulsion as claimed in claim 5, wherein said host grain has a diameter of from 0.3 to 4.0 μm and a thickness of from 0.05 to 0.5 μm.

7. The method for producing a silver halide photographic emulsion as claimed in claim 6, wherein said host grain has a diameter of from 0.4 to 3.0 μm and a thickness of from 0.08 to 0.4 μm.

8. The method for producing a silver halide photographic emulsion as claimed in claim 1, wherein said host emulsion comprises silver bromide or silver iodobromide tabular grains having an average silver iodide content ($I_1$ mol %) of the entire silver halide grains of 4 mol % or less.

9. The method for producing a silver halide photographic emulsion as claimed in claim 1, wherein ($I_2$−$I_1$) is from 0 to 8, where $I_2$ mol % represents the ratio of said iodide ion added in step (b) to the total amount of silver contained in said host emulsion.

10. The method for producing a silver halide photographic emulsion as claimed in claim 9, wherein ($I_2$−$I_1$) is from 0 to 4, where $I_2$ mol % represents the ratio of said iodide ion added in step (b) to the total amount of silver contained in said host emulsion.

11. The method for producing a silver halide photographic emulsion as claimed in claim 1, wherein the concentration of said iodide ion added in step (b) is 0.2 mol/liter or less.

12. The method for producing a silver halide photographic emulsion as claimed in claim 11, wherein the concentration of said iodide ion added in step (b) is 0.1 mol/liter or less.

13. The method for producing a silver halide photographic emulsion as claimed in claim 1, wherein the temperature T° C. and the pAg of said host emulsion, when an iodide ion is added to said host emulsion, are within the region A in FIG. 3.

14. The method for producing a silver halide photographic emulsion as claimed in claim 1, wherein said tabular grains in said host emulsion have two or more interior regions substantially different in silver iodide contents and the silver iodide content of the outermost layer of said tabular grains in said host emulsion is substantially zero.

15. The method for producing a silver halide photographic emulsion as claimed in claim 1, wherein said periphery reclaimed in step (c) of said final tabular grains has dislocation lines.

16. The method for producing a silver halide photographic emulsion as claimed in claim 1, wherein said final tabular grains have dislocation lines present only at the edges and corners thereof.

17. A silver halide photographic emulsion produced by a method comprising the steps of:

(a) producing a host emulsion comprising silver bromide or silver iodobromide hexagonal or triangular {111} tabular grains having an average silver iodide content ($I_1$ mol %) of the entire silver halide grains of said host emulsion of 5 mol % or less, in which 60% or more of the projected area of said entire silver halide grains accounting for tabular grains having an aspect ratio of 3.0 or more;

(b) dissolving a periphery of said tabular grains completely with an iodide ion being added to said host emulsion; and then (c) producing final tabular grains by reclaiming a periphery containing silver iodobromide from the region containing said periphery having been completely dissolved.

18. The silver halide photographic emulsion as claimed in claim 1, wherein 60% or more of the projected area of said entire silver halide grains accounting for tabular grains have an aspect ratio of from 7.0 to 20.

19. A silver halide photographic material comprising a support having provided thereon a photographic emulsion layer containing a silver halide photographic emulsion, said silver halide photographic emulsion being produced by a method comprising the steps of:

(a) producing a host emulsion comprising silver bromide or silver iodobromide hexagonal or triangular {111} tabular grains having an average silver iodide content ($I_1$ mol %) of the entire silver halide grains of said host emulsion of 5 mol % or less, in which 60% or more of the projected area of said entire silver halide grains accounting for tabular grains having an aspect ratio of 3.0 or more;

(b) dissolving in a periphery of said tabular grains completely with an iodide ion being added to said host emulsion; and then (c) producing final tabular grains by reclaiming a periphery containing silver iodobromide from the region containing said periphery having been completely dissolved.

20. The silver halide photographic material as claimed in claim 19, wherein 60% or more of the projected area of said entire silver halide grains accounting for tabular grains have an aspect ratio of from 7.0 to 20.

* * * * *